United States Patent [19]

Kaneko et al.

[11] 4,263,829

[45] Apr. 28, 1981

[54] TRILL PERFORMANCE CIRCUIT IN ELECTRONIC MUSICAL INSTRUMENT

[75] Inventors: Makoto Kaneko, Hamakita; Akio Imamura, Hamamatsu, both of Japan

[73] Assignee: Nippon Gakki Seizo Kabushiki Kaisha, Hamamatsu, Japan

[21] Appl. No.: 122,813

[22] Filed: Feb. 20, 1980

[30] Foreign Application Priority Data

Feb. 23, 1979 [JP] Japan ..... 54/20572

[51] Int. Cl.[3] ..... G10H 1/30; G10H 7/00

[52] U.S. Cl. ..... 84/1.03; 84/1.24; 84/DIG. 2

[58] Field of Search ..... 84/1.01, 1.03, 1.24, 84/DIG. 2, DIG. 12

[56] References Cited

U.S. PATENT DOCUMENTS

| | | | |
|---|---|---|---|
| 3,432,607 | 3/1969 | Bergman | 84/1.03 X |
| 3,549,777 | 12/1970 | Bunger | 84/1.03 |
| 3,549,778 | 12/1970 | Munch, Jr. | 84/1.03 |
| 3,553,335 | 1/1971 | Bunger | 84/1.03 |
| 3,910,150 | 10/1975 | Deutsch et al. | 84/1.03 |
| 4,160,404 | 7/1979 | Yamada et al. | 84/1.03 X |
| 4,166,405 | 9/1979 | Hiyoshi et al. | 84/1.24 |
| 4,171,658 | 10/1979 | Aoki et al. | 84/1.03 |
| 4,178,825 | 12/1979 | Deutsch | 84/1.24 |
| 4,192,211 | 3/1980 | Yamaga et al. | 84/1.01 |
| 4,192,212 | 3/1980 | Yamaga et al. | 84/1.03 |

*Primary Examiner*—S. J. Witkowski

[57] ABSTRACT

An electronic musical instrument is of a type in which a particular note tone and tones corresponding to the remaining notes among depressed keys are alternately and repeatedly produced in accordance with tone production timing signals having a predetermined period. The tone production timing signals are produced by frequency dividing tempo pulses generated from a tempo pulse oscillator. An alternate production control is conducted by gating alternately signal of the particular note tone and signals of other tones and delivering to a sound system. The period of the tone production timing signals can be controlled by a circuit which detects depression of plural keys.

26 Claims, 19 Drawing Figures

1μs
(a)
(b)
(c)
(d)
(e)
(f)
(g)
(h)
(i)
(j)
(k)
(l)
(m)
Φ1
Φ2
SY'
3Y1
ΦA
ΦB
OUTPUT OF LATCH 34
CL1
SPF
SPT
ch1
ch2
ch3
ch4
ch5
ch6
ch7
SP1
SP2
SP3
SP4
SP5
SP6
SP7
TIME

TRILL PERFORMANCE CIRCUIT IN ELECTRONIC MUSICAL INSTRUMENT

BACKGROUND OF THE INVENTION

This invention relates to electronic musical instruments, and more particularly to a trill performance circuit in an electronic musical instrument.

An electronic musical instrument in which tone source signals different in footage corresponding to a depressed key are alternately produced in order to obtain a performance effect such as a marimba effect has been disclosed by Japanese Utility Model Laid-Open No. 52136/1978.

In the electronic musical instrument, tones different in footage are merely alternately produced. Therefore, the instrument cannot provide a performance effect that, when two different keys are depressed, the tones of the two different keys are alternately produced. Thus, the performance characteristic of the instrument is still insufficient.

SUMMARY OF THE INVENTION

In view of the foregoing, an object of this invention is to provide a trill performance circuit for an electronic musical instrument, by which the tones of different keys which are depressed simultaneously are alternately produced.

The alternate tone production according to the invention is effected in the following manners:

(1) In the case where two keys are depressed simultaneously, the musical tones of the two keys are alternately and repeatedly produced.

(2) In the case where more than two keys are depressed simultaneously, the tone production of a particular key among the depressed keys and the simultaneous tone production of the remaining keys are alternately carried out.

(3) In the case where only one key is depressed, the tone of the key is repeatedly produced.

(4) In the case (1) or (2), the time interval of repetition of each tone production is twice as long as that in the case (3).

The particular note in the case (2) is a selected one such as the highest or lowest note among the notes of plural depressed keys, or an intermediate note. Two particular notes may be selected. For instance, the two particular notes may be the highest and lowest notes, or notes ranged from the highest (or lowest) note to the n-th note (n being 2 or more). The aforementioned repeated tone production manner according to the invention will be referred to as "twin mallet trill" performance hereinafter.

In order to achieve the foregoing object and other objects of the invention, a trill performance circuit according to the invention comprises a particular note detecting means for detecting a particular note among the notes corresponding to a single key through plural keys, so that the tone of the particular note thus detected and the tones of the remaining notes are alternately produced. In the case where the particular note is the highest note (or the lowest note) and two keys are depressed simultaneously, the tone of the highest (or lowest) note and the remaining tone, i.e. the tone of the lowest (or highest) note are alternately produced. In the case where more than two keys are depressed, tone production of the highest (or lowest) and simultaneous tone production of the remaining notes are effected alternately. In the case where only one key is depressed, the tone of the highest (or lowest) note detected is repeatedly produced with the period of repeat tone production.

Furthermore, the trill performance circuit according to the invention has means for detecting depression of more than one key, so that the repeated tone production manner is changed according to the detection result of the means. In addition, the performance effect circuit comprises a flip-flop whose state is changed from "1" to "0" or from "0" to "1" in response to a signal which sets the tone production timing of repeated tones, so that, where depression of more than one key is detected, the particular tone and the remaining tones are alternately produced. In the case where only one key is depressed, the tone production is controlled without using the flip-flop. The trill performance circuit can be so modified as to change the time interval of tone repetition according to whether or not more than one key are depressed.

Figure 1:
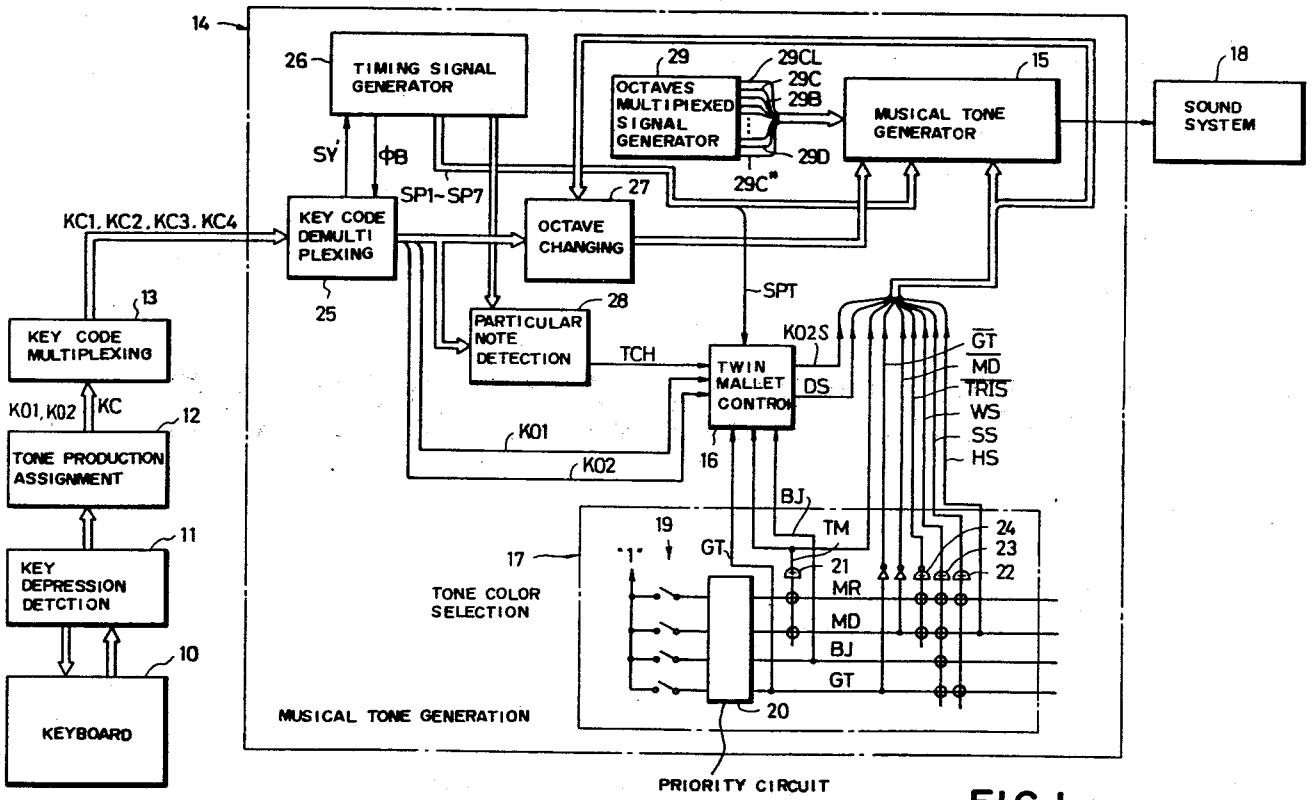
FIG. 1 is a block diagram showing the entire arrangement of one example of an electronic musical instrument according to this invention.
Figure 12:
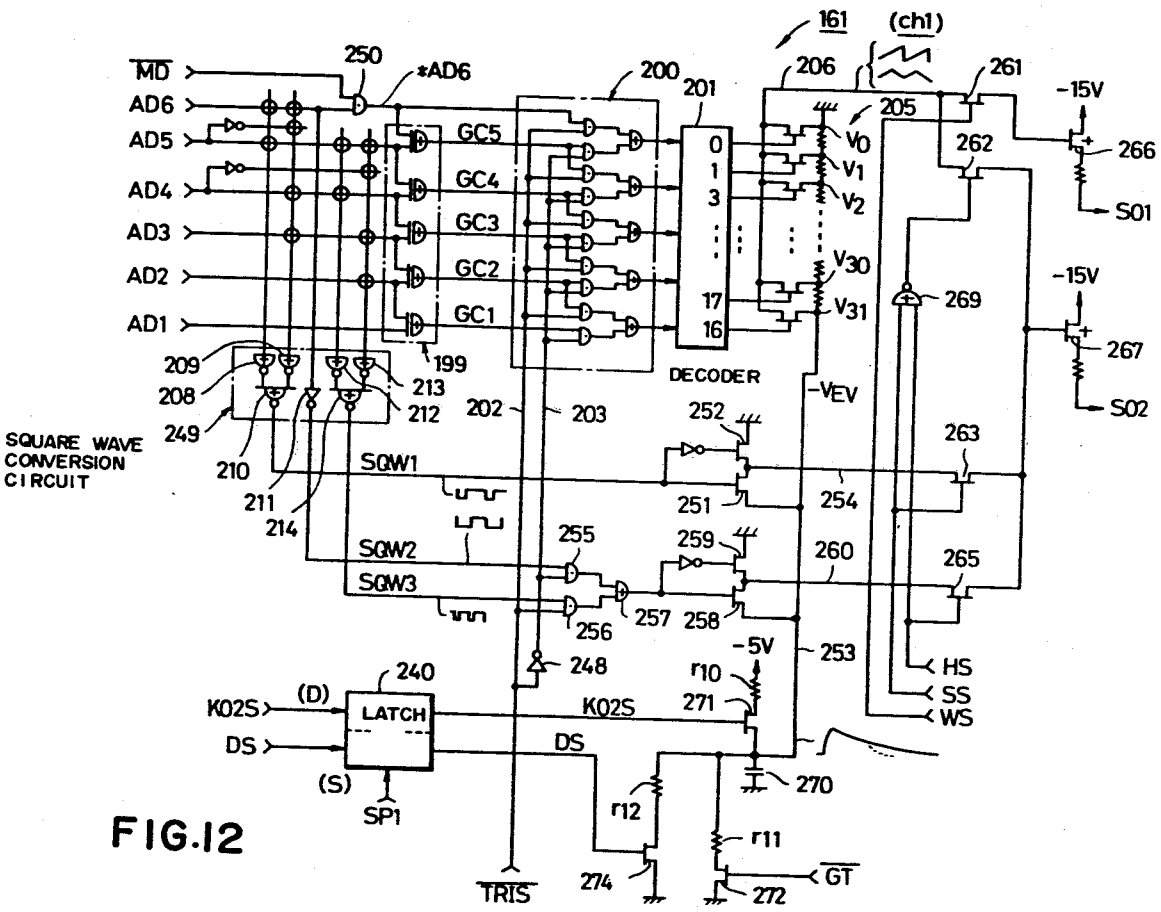
FIG. 12 is a detailed circuit diagram illustrating one example of a musical tone waveform generator in FIG. 9.
Figure 13A:
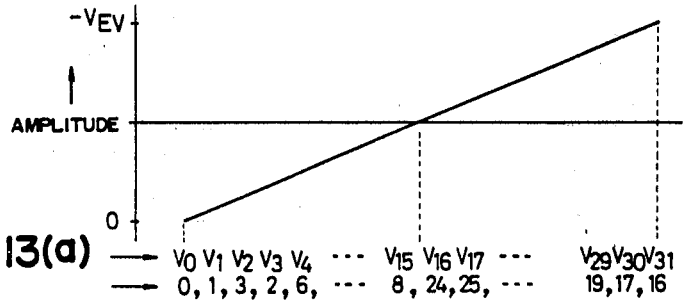
Figure 13B:
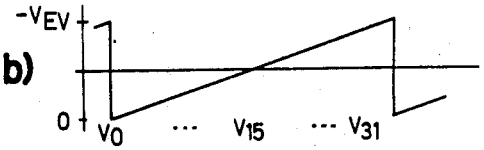
Figure 13C:
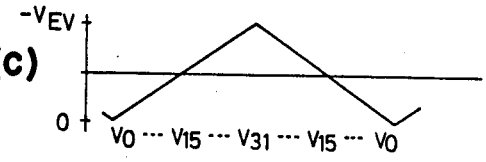
Figure 14:
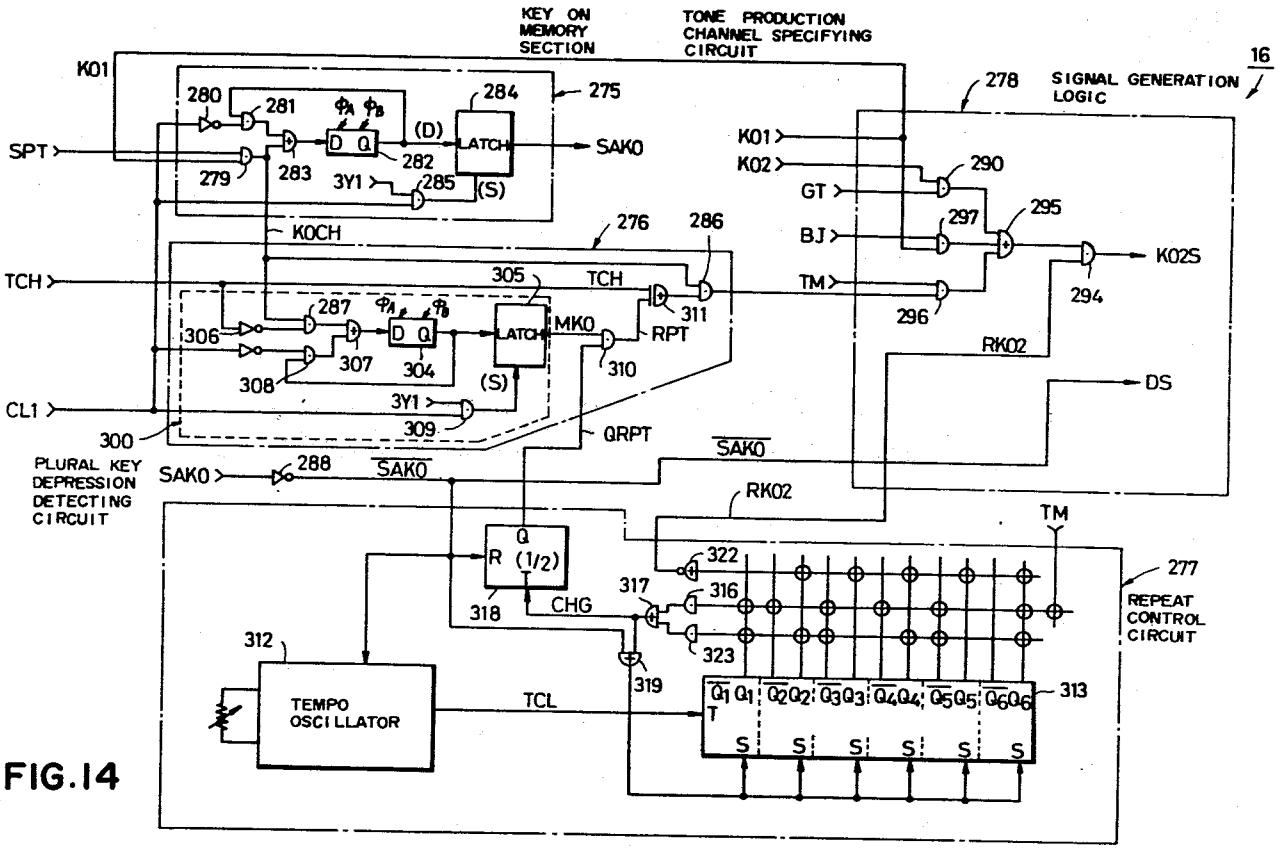
Figure 15:
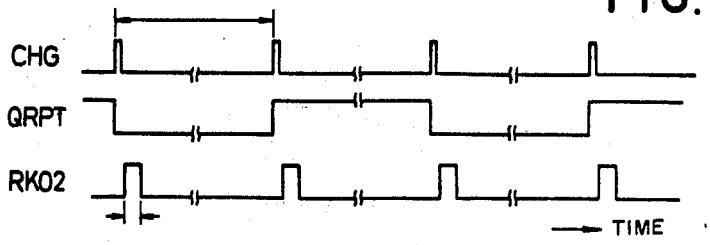
Figure 16:
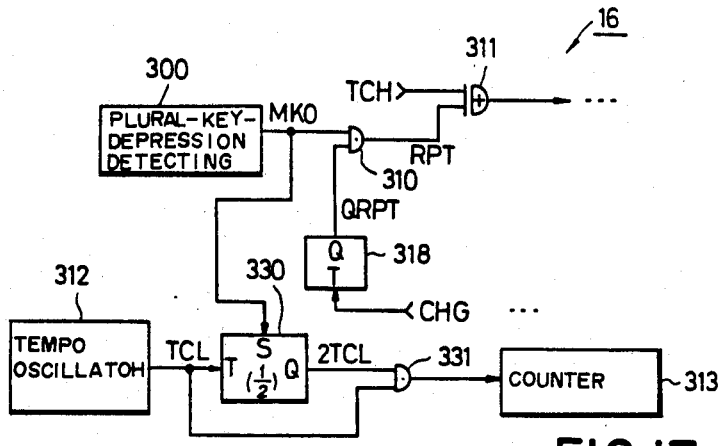
Figure 17:
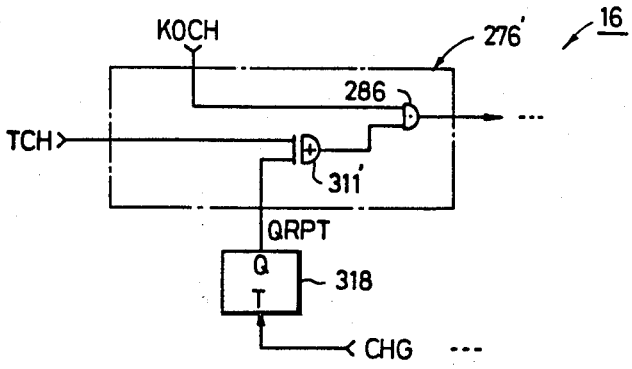

The part (a) of FIG. 13 is a graphical representation indicating one example of a waveform which is stored in a musical tone waveform memory in FIG. 12;

The parts (b) and (c) of FIG. 13 are also graphical representations for a description of the operation of reading a saw tooth waveform or a triangular waveform from the stored waveform shown in the part (a) of FIG. 13;

FIG. 14 is a circuit diagram showing one example of a twin mallet control section in FIG. 1;

FIG. 15 is a timing chart for a description of the control for a twin mallet trill performance in the circuit shown in FIG. 14;

FIG. 16 is a block diagram showing essential parts of one modification of the twin mallet control section in FIG. 14; and FIG. 17 is a block diagram showing essential parts of another modification of the twin mallet control section.

DETAILED DESCRIPTION OF THE INVENTION

(Brief Description of the Entire Arrangement)

Referring to FIG. 1, a key depression detecting circuit 11 operates to detect keys depressed in a keyboard 10 and to supply data representative of depressed keys to a tone production assignment circuit 12. The tone production assignment circuit 12 operates to assign the tone production of depressed keys to available ones of tone production channels whose number is predetermined.

The tone production assignment circuit 12 delivers in time division manner key codes KC representative of depressed keys assigned to the channels. Each key code KC consists of a 4-bit note code N1, N2, N3, N4 for distinguishing twelve notes C through B from one another and a 3-bit block code B1, B2, B3 for identifying an octave range to which a given note belongs. Furthermore, the tone production assignment circuit 12 outputs in time division manner a first 1-bit key-on signal KO1 which represents whether a key assigned to a relevant channel is being depressed ("1") or has been released ("0"), outputs a second key-on signal KO2 which is set to "1" for a very short time after depression of a key, and outputs a variety of control data (not described) when required. The generation time width of the second key-on signal KO2 is of the order of about 5 ms for instance. The second key-on signal KO2 is used to control a decaying tone.

The key code KC, the key-on signals KO1 and KO2, and the control data are applied to a key code multiplexing circuit 13, where they are converted into a 4-bit data KC1, KC2, KC3, KC4. The reason for converting the key data into the data KC1–KC4 having a small number of bits is to minimize the number of leads which connect the IC chip on the side of the tone production assignment circuit 12 to the IC chip on the side of a musical tone production circuit 14. Before multiplexing and delivering the key data, the data multiplexing circuit 13 outputs a reference data which is used to locate time slots where the key data of the channels exist. The reference data is the data KC1, KC2, KC3, KC4 whose contents are all at "1".

Figure 2:
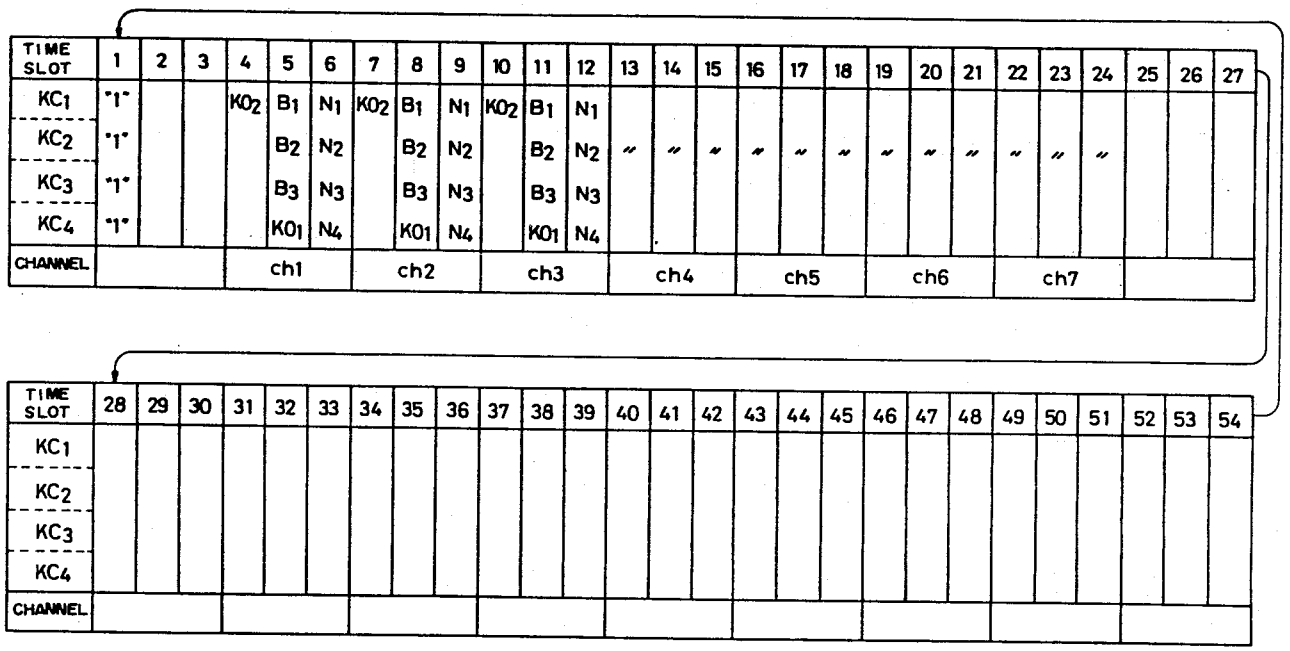
FIG. 2 is an explanatory diagram showing the contents of data provided in time division manner by a key code multiplexing circuit in FIG. 1, with respect to time slots.

The total number of time slots for the data KC1–KC4 outputted by the key code multiplexing circuit 13 is fifty-four (54). The states of time slots 1 through 54 are as indicated in FIG. 2, with the time slot in which the reference data "1 1 1 1" occurs being numbered "1". In FIG. 2, reference characters ch1 through ch7 designate seven tone production channels in a musical tone generating circuit 15 (FIG. 1) used for realizing the present invention. The time slots 1 through 24 are used for delivery of the data assigned to the channels ch1 through ch7. The remaining time slots are not labeled, as they have no relation with the present invention, although they are used for other tone production in an actual electronic musical instrument model. The time slots 1 through 54 occur repeatedly.

It is apparent from FIG. 2 that, with respect to the multiplex data KC1 through KC4, three time slots are provided for each tone production channel. If it is assumed that one time slot corresponds to one bit time, then the channel for the data KC1–KC4 is changed every three bit-times. Furthermore, it is clear from FIG. 2 that in the first time slots 4, 7, 10 . . . and 22 of the tone production channels, the second key-on signals KO2 are assigned to the least significant data KC1, respectively.

In addition, it is also clear from FIG. 2 that the block code B1–B3 is assigned to the data KC1–KC3, the first key-on signal KO1 is assigned to the data KC4, and the note code N1–N4 is assigned to the data KC1–KC4.

The block code B1–B3 and first key-on signal KO1 of a channel (or a key) is assigned to a time slot (2, 5, 8, . . . or 23) before the time slot of the respective note code N1–N4. In other words, the block codes B1–B3 and first key-on signals KO1 of the channels (or depressed keys) appear in the data KC1–KC4 every three bit-times. The note codes N1–N4 are assigned to the time slots 3, 6, . . . and 24; that is, they also appear in the data KC1–KC4 every three bit-times.

An electronic musical instrument using the abovedescribed data multiplexing circuit 13 is disclosed in detail in the specification of U.S. Pat. No. 4,192,211, and is not essential for the present invention, and therefore the detailed description thereof will be omitted.

One example of the relation between the states of the note codes N1–N4 and twelve notes C# through C is as indicated in Table 1.

TABLE 1

| Note | N4 | N3 | N2 | N1 | Decimal notation |
|---|---|---|---|---|---|
| C# | 0 | 0 | 0 | 1 | 1 |
| D | 0 | 0 | 1 | 0 | 2 |
| D# | 0 | 0 | 1 | 1 | 3 |
| E | 0 | 1 | 0 | 1 | 5 |
| F | 0 | 1 | 1 | 0 | 6 |
| F# | 0 | 1 | 1 | 1 | 7 |
| G | 1 | 0 | 0 | 1 | 9 |
| G# | 1 | 0 | 1 | 0 | 10 |
| A | 1 | 0 | 1 | 1 | 11 |
| A# | 1 | 1 | 0 | 1 | 13 |
| B | 1 | 1 | 1 | 0 | 14 |
| C | 1 | 1 | 1(0) | 1(0) | 15 |

As is clear from Table 1, the values of the note codes N1–N4 correspond to the tone pitches of the notes C# through C, respectively, wherein the note C# is lowest in tone pitch and the note C is highest in tone pitch within an octave. However, it should be noted that the value for the note C is converted from "1 1 1 1" to "1 1 0 0" by the data multiplexing circuit 13, in order to prevent the confusion of the value for the reference data "1 1 1 1" which otherwise may occur in transmission in the form of data KC1–KC4 (cf. the time slot 1 in FIG. 2).

One example of the relation between the contents of the block codes B1–B3 and the octave ranges is as shown in Table 2 below.

TABLE 2

| B3 | B2 | B1 | Octave Range |
|---|---|---|---|
| 0 | 0 | 0 | C2 |
| 0 | 0 | 1 | C#2–C3 |
| 0 | 1 | 0 | C#3–C4 |
| 0 | 1 | 1 | C#4–C5 |
| 1 | 0 | 0 | C#5–C6 |

TABLE 2-continued

| B3 | B2 | B1 | Octave Range |
|---|---|---|---|
| 1 | 0 | 1 | C#6–C7 |

The musical tone generating circuit section 14 operates to take the note codes N1–N4, the block codes B1–B3 and the key-on signals KO1 and KO2, separately according to the channels, out of the multiplex data KC1–KC4 supplied from the key code multiplexing circuit 13 and to produce musical tones in the channels ch1 through ch7 in the musical tone generating circuit 15 according to the key data thus taken. In order to demultiplex the key data N1-KO2 and to distribute the thus demultiplexed key data to the channels, a key code demultiplexing circuit 25 and a timing signal generating circuit 26 are provided. Furthermore, an octave changing circuit 27 is provided in order to change the sounding tone octave according to the tone color. A particular note detecting circuit 28 operates to detect a particular one of the notes of keys being depressed. In this example, the particular note is the highest of the notes of keys being depressed.

The data (TCH) of the highest note detected by the particular note detecting circuit 28 is applied to a twin mallet control section 16, for providing the twin mallet trill performance effect. In the section 16, the channel of the particular note (high note) is distinguished from the channels of the other key-depressed notes according to the highest note data TCH, the key-on signals KO1 and KO2 from the demultiplexing circuit 25 and a signal SPT from the timing signal generating circuit 26 so as to provide key-on signals KO2S alternately in the channels thus distinguished. The section 16 provides a decay signal DS in order to finish tone production.

A tone color selecting section 17 operates to select a tone color which should be formed by the musical tone generating circuit 15. In this example, the tone color selecting section 17 is so designed as to select one of four tone colors, i.e. marimba, mandolin, banjo and guitar. The twin mallet trill performance effect according to the invention is obtained when a particular tone color (of marimba or mandolin) is selected.

An octaves multiplexed signal generating section 29 is employed as a tone source clock signal generating means of the musical tone generating circuit 15. In the musical tone generating circuit 15, the tone source clock signals for the notes assigned to the channels ch1 through ch7 are obtained from the octaves multiplexed signal generating section 29 thereby to produce tone source signals, and according to the key-on signals KO2S provided by the twin mallet control section 16, notes of relevant channels are switched alternately. Musical tone signals delivered out from the musical tone generating circuit 15 are produced as tones by a sound system 18.

(Description of the Detailed Arrangement of Various Parts)

Selection of Tone Colors

The tone color selecting section 17, as shown in FIG. 1 has tone color selecting switches 19 provided respectively for the tone colors (of marimba, mandolin, banjo and guitar). The outputs of the switches 19 are applied to a priority circuit 20. When a plurality of tone colors are selected by the tone color selecting switches 19, the priority circuit 20 gives priority in selection to one of the plurality of tone colors thus selected. The order of priority is marimba (MR), mandolin (MD), banjo (BJ) and guitar (GT). A marimba selection signal MR and a mandolin selection signal MD delivered by the priority circuit 20 are applied to an OR circuit 21, the output of which is utilized as a twin mallet selection signal TM.

A variety of tone color control signals HS, SS, WS, $\overline{TRIS}$, $\overline{MD}$ and $\overline{GT}$ are provided according to the outputs of the priority circuit 20. More specifically, the signal HS is obtained with the aid of the mandolin selection signal MD. The signal SS is provided by an OR circuit 22 to which the guitar selection signal GT and the marimba selection signal MR are applied. The signal $\overline{TRIS}$ is provided by circuit 23 to which all of the selection signals MR through GT are applied. The signal $\overline{TRIS}$ is provided by a NOR circuit 24 to which the marimba selection signal MR and the mandolin selection signal MD are applied. The signal $\overline{MD}$ is obtained by inverting the mandolin selection signal MD. The signal $\overline{GT}$ is obtained by inverting the guitar selection signal GT. That is, the signal $\overline{TRIS}$ represents that none of the mandolin and marimba tone colors are selected; the signal $\overline{MD}$ represents that the mandolin tone color is not selected; and the signal $\overline{GT}$ represents that the guitar tone color is not selected.

Detection of the reference data "1 1 1 1"

Figure 3:
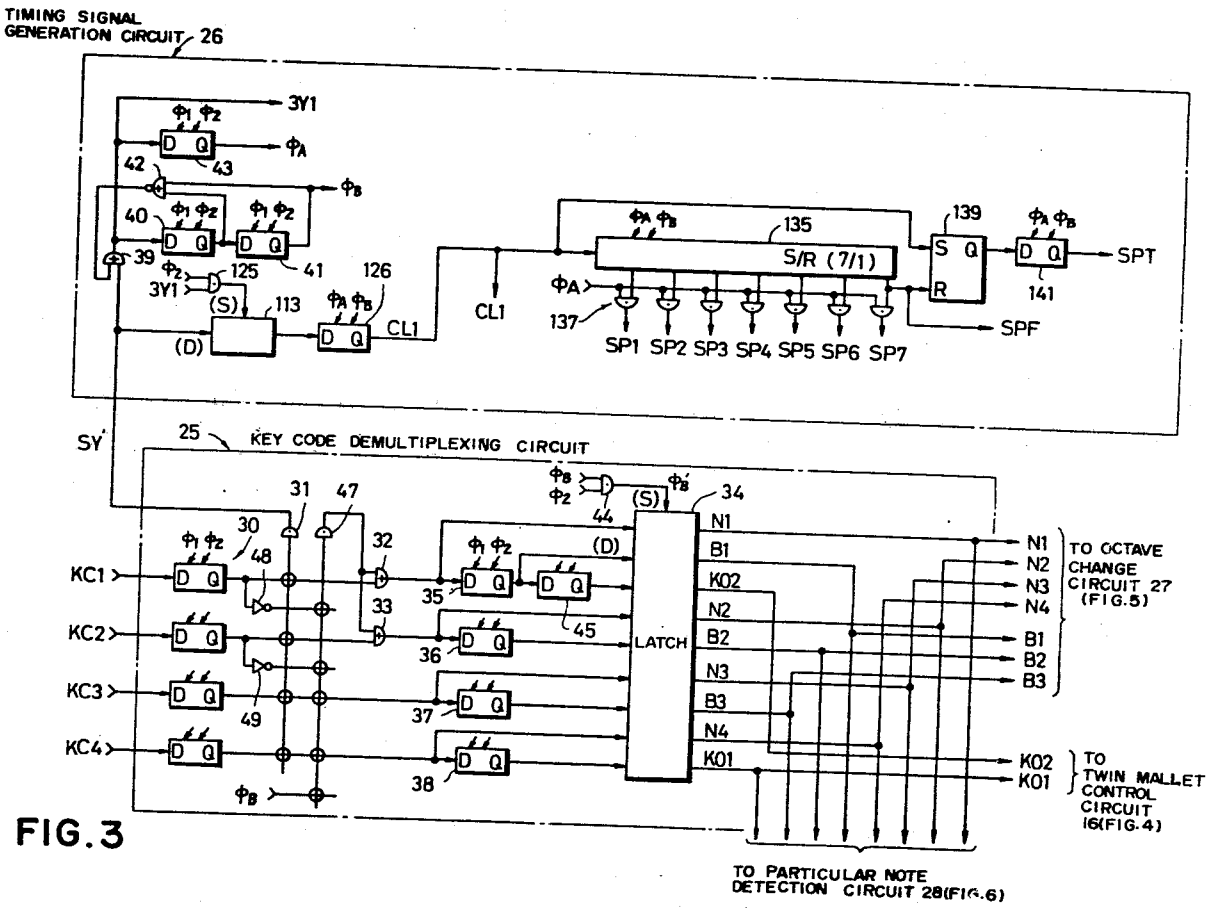
FIG. 3 is a detailed circuit diagram showing examples of a key code demultiplexing circuit and a timing signal generator in FIG. 1.

The key code demultiplexing circuit 25 and the timing signal generating circuit 26 are shown in detail in FIG. 3. The data KC1–KC4 from the key code multiplexing circuit 13 are applied to the key code demultiplexing circuit 25, where they are delayed by one bit-time by a delay flip-flop group 30. Each flip-flop in the delay flip-flop group 30 is driven by two-phase clock pulses $\phi 1$ and $\phi 2$ having a period of one bit-time (for instance 1 $\mu$s). The data KC1–KC4 delivered by the delay flip-flop group 30 are applied to an AND circuit 31. At the same time, the data KC1 is applied through an OR circuit 32 to a latch circuit 34 and a delay flip-flop 35, the data KC2 is applied through an OR circuit 33 to the latch circuit 34 and a delay flip-flop 36, the data KC3 is applied to the latch circuit 34 and a delay flip-flop 37, and the data KC4 is applied to the latch circuit 34 and a delay flip-flop 38.

The AND circuit 31, receiving all of the data KC1 through KC4, operates to detect the reference data "1 1 1 1". Time slots for the multiplexed data KC1–KC4 delivered by the delay flip-flop group 30 are as shown in the part (a) of FIG. 4. The time slots correspond to those in FIG. 2. The aforementioned two-phase clock pulses $\phi 1$ and $\phi 2$ are as shown in the part (b) of FIG. 4. As is clear from FIG. 2, the reference data "1 1 1 1" is provided in the time slot 1 of the data KC1–KC4. Therefore, when the output of the AND circuit 31 is raised to "1", the time slot is slot No. 1. The output "1" of the AND circuit 31 is applied, as a reference pulse signal SY' (FIG. 4, (*c*)), to the timing signal generating circuit 26.

In the timing signal generating circuit 26, basing on the input of the reference signal SY' the occurrences of the following time slots 2 through 54 are decided, and controlling clock pulses 3Y1, $\phi$A and $\phi$B having a period of three bit-times and control pulses SP1 through SP7 for distributing the key data to the channels of the musical tone generating circuit 15 are produced.

Production of the controlling clock pulses 3Y1, $\phi$A and $\phi$B

In the time signal generating circuit 26 (FIG. 3), the reference pulse signal SY' is applied through an OR circuit 39 to a delay flip-flop 40, the output of which is applied to a delay flip-flop 41. The outputs of the two flip-flops 40 and 41 are applied through a NOR circuit 42 to the OR circuit 39. The output of the OR circuit 39 is further applied to a delay flip-flop 43. The delay flip-flops 40, 41 and 43 are driven by the clock pulses $\phi 1$ and $\phi 2$. In the time slot 3 two bit-times after the time slot 1 in which the reference pulse signal SY' is applied to the OR circuit 39, the output of the delay flip-flop 41 is raised to "1", and in the time slot 4 three bit-times after the time slot 1, the outputs of the delay flip-flops 40 and 41 are set to "0", and accordingly the output of the NOR circuit 42 is raised to "1". The output "1" of the NOR circuit 42 is applied to the OR circuit 39, as a result of which the output of the OR circuit 39 is raised to "1" with a period of three bit-times. Thus, the control pulse 3Y1 (FIG. 4, (*d*)), the controlling clock pulse $\phi A$ (FIG. 4, (*e*)), and the controlling clock pulse $\phi B$ (FIG. 4, (*f*)) are outputted by the OR circuit 39, the delay flip-flop 43 and the delay flip-flop 41 with a period of three bit-times, respectively.

Demultiplexing of the key data

In the key code demultiplexing circuit 25 in FIG. 3, the latch circuit 34 has seven (7) latch positions for a note code N1–N4, a block code B1–B3 and key-on signals KO1 and KO2. An output of an AND circuit 44 is applied to the latch control (strobe) input (S) of the latch circuit 34. The aforementioned controlling clock pulse $\phi B$ and clock pulse $\phi 2$ are applied to the input terminals of the AND circuit 44. Accordingly, the AND circuit 44 provides a pulse $\phi B'$ which is obtained by selecting the clock pulse $\phi B$ only in the first half of the time slot (corresponding to the time width of the clock pulse $\phi 2$) in which the clock pulse $\phi B$ occurs. Thus, the pulse $\phi B'$ is equal in generation timing to but different in pulse width from the pulse $\phi B$.

The latch circuit 34 operates to simultaneously latch at the timing of the pulse $\phi B'$ the key data N1–N4, B1–B3, KO1, KO2 for one channel which are supplied in the form of data KC1–KC4 in a time division multiplexed manner. For this purpose, the data KC1–KC4, after being suitably shifted by the delay flip-flops 35 through 38, are applied to the data input terminals (D) of the latch positions in the latch circuit 34, respectively.

Figure 4:
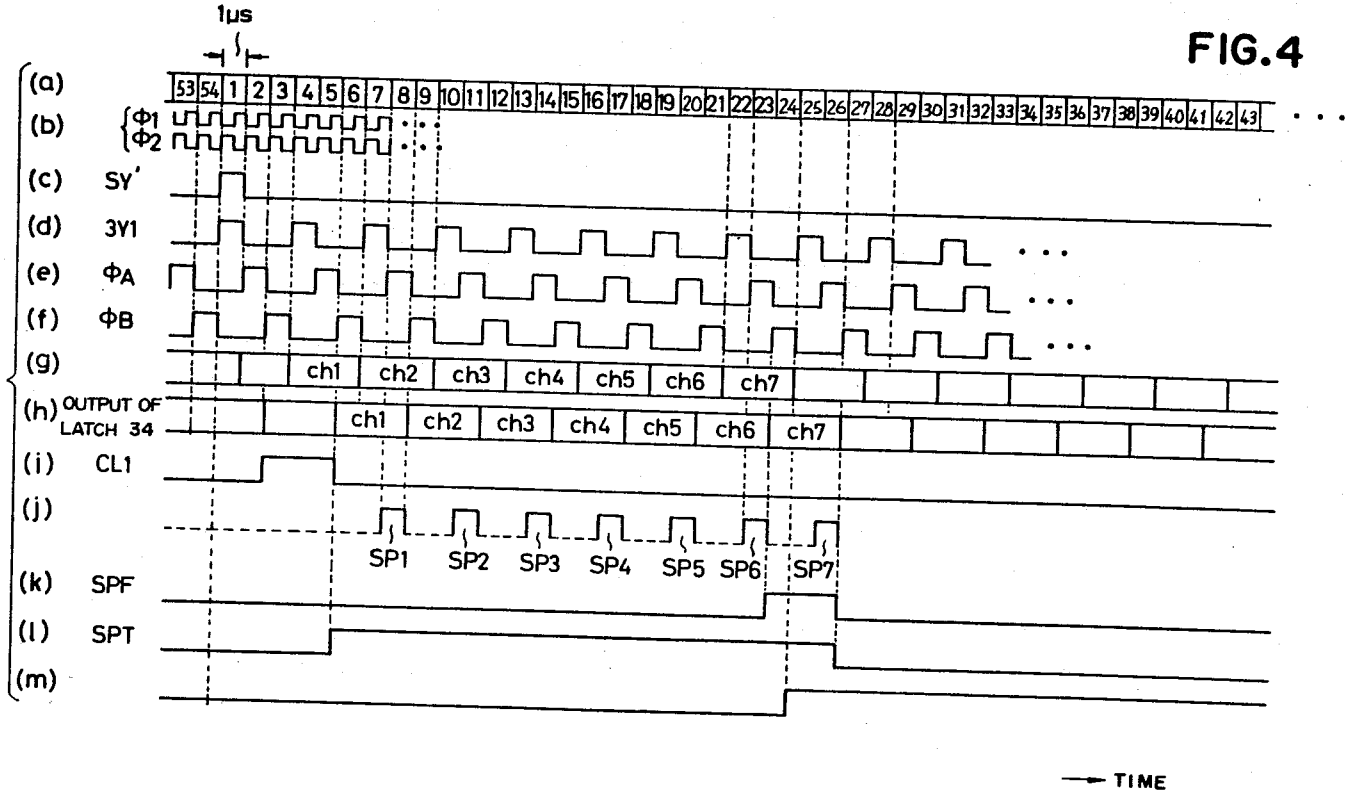
FIG. 4 is a timing chart indicating various signals in the circuit in FIG. 3.

It is apparent from FIGS. 2 and 4 that the pulses $\phi B$ ($\phi B'$) are provided in synchronization with the time slots 6, 9, 12, . . . in which the note codes N1–N4 are supplied as data KC1–KC4. Therefore, the bits of the data KC1–KC4 delivered by the delay flip-flop group 30 are applied directly to the latch positions which correspond to the bits of the note code N1–N4, respectively. The block code B1–B3 and the first key-on signal KO1 of a channel are supplied in the form of data KC1–KC4 in the time slot immediately before the time slot of the note code N1–N4. The bits of the data KC1–KC4, after being delayed by one bit-time by the delay flip-flops 35 through 38, are applied to the latch positions corresponding to the block code B1–B3 and the key-on signal KO1, respectively. Furthermore, the second key-on signal KO2 of the same channel is supplied in the form of data KC1 in the time slot immediately before the time slot of the data B1–B3. Thus, the data KC1 delayed by the delay flip-flop 35 is further delayed by one bit-time by the delay flip-flop 45, and is then applied to the latch position corresponding to the second key-on signal KO2.

As is apparent from the above description, when the latch control pulse $\phi B'$ is produced, the note code N1–N4, the block code B1–B3 and the key-on signals KO1 and KO2 of the same channel are simultaneously applied to the input of the latch circuit 34, as a result of which these key data are simultaneously latched. The memory contents of the latch circuit 34 are rewritten in response to the latch control pulse $\phi B'$, i.e. every three bit-times. The channel for the data KC1–KC4 is changed every 3 bit-times (cf. FIG. 2), and therefore the contents of the latch circuit 34 are rewritten into the key data N1–N4, B1–B3, KO1, KO2 of a different channel successively every 3 bit-times.

The states of the data KC1–KC4 in the time slots 1 through 54 in FIG. 2 are shown in simple form in the part (g) of FIG. 4, in which reference characters ch1 through ch7 designate the channels, respectively. The part (h) of FIG. 4 indicates the channels to which the key data N1–KO2 delivered by the latch circuit 34 are assigned. For instance, in response to the latch control pulse $\phi B'$ provided at the time slot 6, the key depression data N1–N4, B1–B3, KO1, KO2 assigned to the channel ch1 are loaded into the latch circuit 34, and the data thus loaded are delivered continuously for a period of from the time slot 6 to the time slot 8. In response to the latch control pulse $\phi B'$ provided at the next time slot 9, the key depression data N1–KO2 assigned to the channel ch2 are loaded into the latch circuit, and the data thus loaded are delivered continuously from the time slot 9 to the time slot 11. Thus, as shown in the part (h) of FIG. 4, the channel of the key data N1–KO2 delivered by the latch circuit 34 is changed.

A circuit formed with the OR circuits 32 and 33, the AND circuit 47 and inverters 48 and 49 which are provided in the front stage of the delay flip-flops 35 through 38 operates to cause the note code of note C to have its original value "1 1 1 1". As was described before, in order to avoid the confusion for the reference data "1 1 1 1", the note code N4–N1 of note C, after being converted into "1 1 0 0", is supplied. Therefore, signals obtained by inverting the two least significant bits KC1 and KC2 by the inverters 48 and 49, and the two most significant bits KC3 and KC4 are applied to the 5-input AND circuit 47, so that the AND circuit 47 can detect the arrival of the changed code "1 1 0 0" of note C. Applied to the remaining input of the AND circuit 47 is the pulse $\phi B$, so that the detection is carried out only in the time slot in which the note code N1–N4 is supplied. Upon detection of the changed code "1 1 0 0" of note C, the output of the AND circuit 47 is raised to "1", and the output "1" is applied through the OR circuits 32 and 33 to the latch positions, corresponding to the note code bits N1 and N2, of the latch circuit 34.

Figure 5:
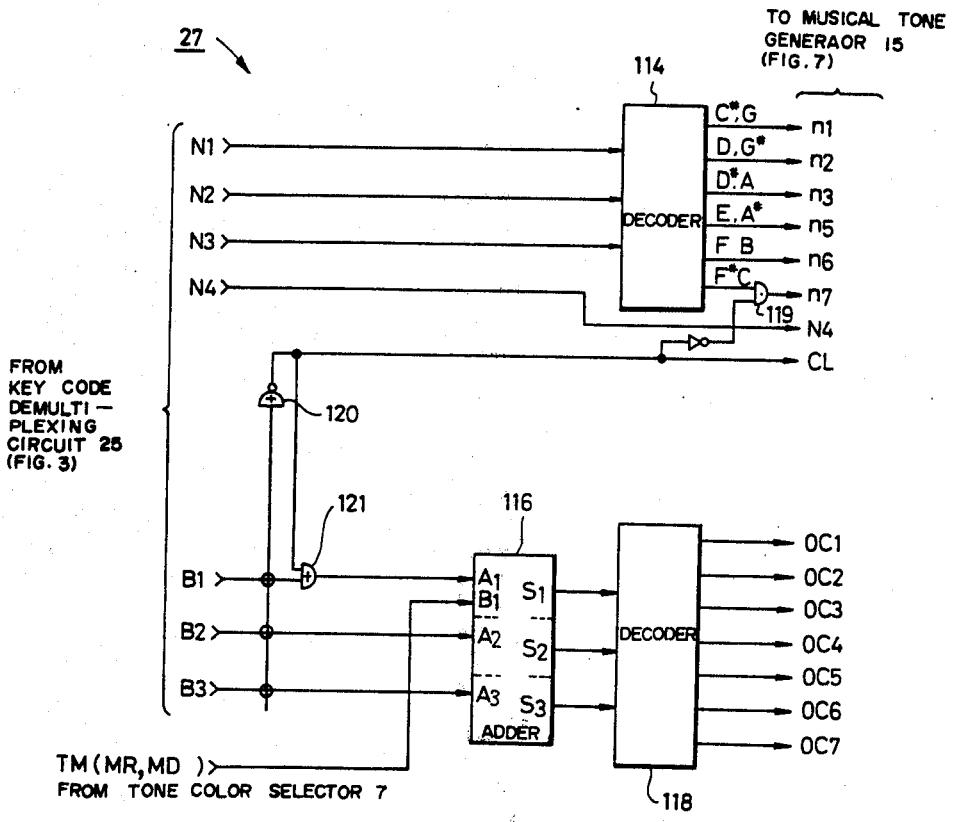
FIG. 5 is a detailed circuit diagram illustrating one example of an octave changing circuit in FIG. 1.

The note code N1–N4 and the block code B1–B3 delivered by the latch circuit 34 are applied to the octave changing circuit 27 (illustrated in detail in FIG. 5). The note code N1–N4, the block code B1–B3, and the first key-on signal KO1 are supplied to the particular note detecting circuit 28 (shown in detail in FIG. 6). The second key-on signal KO2 is applied to the twin mallet control section 16 (shown in detail in FIG. 14).

Octave changing

In the octave changing circuit 27 shown in FIG. 5, the note code N1–N4 from the latch circuit 34 (FIG. 3) in the key code demultiplexing circuit 25 is applied to a decoder 114. The block code B1–B3 from the latch circuit 34 is applied to an adder 116, the addition output of which is applied to a decoder 118. The adder 116 operates to change the value of a block code B1–B3 to change the octave range.

The decoder 114 provides note signal n1 through n7 (n4 skipped though) as indicated in Table 3 below according to the value of the three least significant bits N1, N2, N3 of the note code.

TABLE 3

| Input N3 | N2 | N1 | Output | Note |
|---|---|---|---|---|
| 0 | 0 | 1 | n1 | C#, G |
| 0 | 1 | 0 | n2 | D, G# |
| 0 | 1 | 1 | n3 | D#, A |
| 1 | 0 | 1 | n5 | E, A# |
| 1 | 1 | 0 | n6 | F, B |
| 1 | 1 | 1 | n7 | F#, C |

The note signals n1 through n7 delivered by the decoder 114 are applied to the musical tone generating circuit 15. The channels for the note signals ch1 through ch7 with respect to the time slots are as indicated in the part (h) of FIG. 4. The signal n7 corresponding to notes F# and C is supplied only after it is gated by an AND circuit 119. As the note signals n1 through n7 are insufficient to distinguish the notes from one another, the most significant bit N4 of the note code is also supplied to the musical tone generating circuit 15.

A NOR circuit 120 is provided to detect the note C of the lowest octave. The block code B1, B2, B3 is applied to the NOR circuit 120. When all of the bits B1, B2 and B3 of the block code are at "0", the output of the NOR circuit is raised to "1". As is clear from Table 2, the block code "0 0 0" corresponds only to the note C of the lowest octave. Therefore, for the lowest note C, the output of the NOR circuit 120 is raised to "1". Thus, the output "1" of the NOR circuit 120 is applied, as a signal CL representative of the lowest note C, to the musical tone generating circuit 15. When the output of the NOR circuit 120 is raised to "1" as described above, the output "1" is applied through an inverter to the AND circuit 119, to disable the latter 119, as a result of which the decoded output n7 of the note code of the note C is inhibited. On the other hand, the output "1" of the NOR circuit 120 is applied to the OR circuit 121, so that the block code B3, B2, B1 is changed to "0 0 1". This means that, in the musical tone generating circuit 15, the tone source clock of note C selected by the signal CL is lower by one octave than that of note C selected by the signal n7, and therefore the block code B1–B3 corresponding to the signal CL is increased by one octave.

A signal TM from the tone color selecting section 17 is applied to the least significant bit in the adder 116. The signal TM corresponds to the marimba MR or the mandolin MD. When these tone colors are selected, the performance octave range is increased by one octave.

The decoder 118 operates to decode a 3-bit block code (B1–B3) to output an octave signal (OC1, OC2, . . . or OC7) representative of the octave range of the block code. The relation between the input and the output of the decoder is as indicated in Table 4 below.

TABLE 4

| Decoder 118 Input | Output |
|---|---|
| 001 | OC1 |
| 010 | OC2 |
| 011 | OC3 |
| 100 | OC4 |

TABLE 4-continued

| Decoder 118 Input | Output |
|---|---|
| 101 | OC5 |
| 110 | OC6 |
| 111 | OC7 |

The octave signals OC1 through OC7 delivered by the decoder 118 are supplied to the musical tone generating circuit 15. With respect to the time slots, the channels for the octave signals OC1 through OC7 are as indicated in the part (h) of FIG. 4.

Generation of the control pulses

The timing signal generating circuit 26 in FIG. 3 provides control pulses SP1 through SP7 corresponding respectively to the tone production channels ch1 through ch7 of the musical tone generating circuit 15. The control pulses SP1 through SP7 are control signals to distribute the note signal n1 through n7 from the decoder 114 (FIG. 5), the note code bit N4 and the octave signals OC1 through OC7 from the decoder 118 to the tone production channels ch1 through ch7 in the musical tone generating circuit 15.

In the timing signal generating circuit 26 in FIG. 3, the reference pulse SY' is applied to the data input (D) of a latch circuit 113. The pulse 3Yl provided by the OR circuit 39 and the clock pulse $\phi 2$ are applied to an AND circuit 125 coupled to the latch circuit 113. The output of the AND circuit 125 is applied to the strobe input (S) of the latch circuit 113. Therefore, the content of the latch circuit 113 is rewritten at the time slots 1, 4, 7, . . . (every 3 bit-times) when the pulse 3Y1 is produced. Therefore, the signal "1" is stored in the latch circuit 113 for a period of time of from the time slot 1 to the time slot 3.

The output of the latch circuit 113 is delayed by 2 bit-times by a delay flip-flop 126 which is driven by the two-phase clock pulses $\phi A$ and $\phi B$, as a result of which a signal CL1 (FIG. 4, (*i*)) is provided. The signal CL1 is delivered immediately before the data delivery timing of the channel ch1.

The CL1 thus delivered is applied to a shift register 135 and to the set input (S) of a flip-flop 139. The shift register 135 is of a 7-stage/1-bit, and is driven by the two-phase clock pulses $\phi A$ and $\phi B$ every 3 bit-times. The outputs of the stages in the shift register 135 are provided through an AND circuit group 137 at the timing of the clock pulse $\phi A$. The outputs of the AND circuit group 137 are the aforementioned control pulses SP1 through SP7. The timing of generation of the control pulses SP1 through SP7 is as indicated in the part (j) of FIG. 4. As is clear from comparison of the parts (h) and (j) of FIG. 4, the timing of generation of the control pulses SP1 through SP7 coincide with the timing of delivery of the note signals n1 through n7 of the channels ch1 through ch7, respectively.

The output of the last stage of the shift register 135 is applied, as a completion signal SPF, to the particular note detecting circuit 28. The timing of generation of the completion signal SPF is as indicated in the part (k) of FIG. 4. The production of the completion signal SPF means that one cycle of delivery of the key data N1–N4, B1–B3, KOl and KO2 of the channels has been completed.

The output (SPF) of the last stage in the shift register 135 is applied to the reset input (R) of the flip-flop 139. The output (Q) of the flip-flop 139 is applied to a delay flip-flop 141 which is driven by the clock pulses $\phi A$ and $\phi B$, as a result of which a signal SPT representative of the data delivery period is delivered by the flip-flop 141. As shown in the part (1) of FIG. 4, production of the signal SPT coincides with the data delivery timing of the channels ch1 through ch7.

Detection of the particular note

Figure 6:
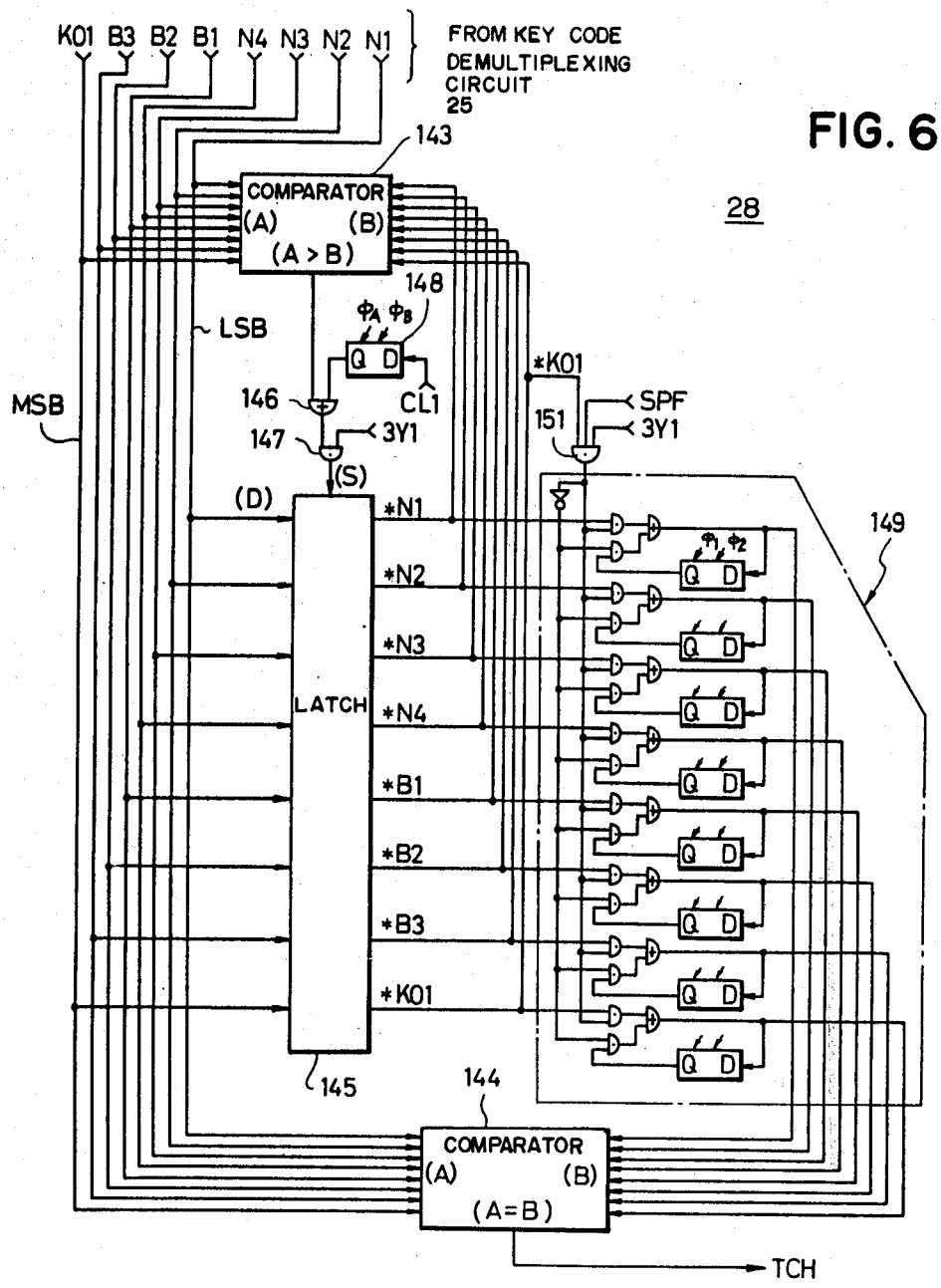
FIG. 6 is a detailed circuit diagram showing a particular note detection circuit in FIG. 1.

The particular note detecting circuit 28 shown in FIG. 6 is so designed as to detect the highest note. In the circuit 28, the note code N1–N4, block code B1–B3 and first key-on signal KO1 from the latch circuit (FIG. 3) in the key code demultiplexing circuit 25 are regarded as an 8-bit digital signal, and the code data N1–KO1 of the channels are successively subjected to comparison, whereby a code data N1–KO1 having the largest value (i.e. the highest note) is detected. The bits KO1, B3, B2, B1, N4, N3, N2, N1 of the data are decreased in weight (significance) in the stated order, the data KO1 being MSB (most significant bit) and the data N1 being LSB (least significant bit). In this case, as is clear from Tables 1 and 2, the values of data B3, B2, B1, N4, N3, N2 and N1 correspond to tone pitches; that is, as the value increases, the tone pitch is increased. As the first key-on signal KO1 (which is maintained at "1" while the key is being depressed) is MSB, the note of a key being depressed takes precedence over the note of a key which has been released.

The note code N1–N4, the block code B1–B3 and the key-on signal KO1 from the latch circuit (FIG. 3) are applied to first inputs (A) of comparison circuits 143 and 144 and to the data input (D) of a latch circuit 145. In the comparison circuit 143, the data N1–KO1 of the channels are successively subjected to comparison. The latch circuit 145, receiving the comparison results from the comparison circuit 143, temporarily stores the larger one of the compared data N1–KO1. The data *N1–*KO1 which is stored in the latch circuit 145 upon completion of the comparison of the data of all the channels is the data of a maximum value, i.e. the data of the highest of the notes of keys depressed (or of the tones produced).

The code *N1–*N4, *B1–*B3, *KO1 stored in the latch circuit 145 is applied to the input (B) of the comparison circuit 143. The input A is compared with the input B in the comparison circuit 143. When A>B, i.e. when the code N1–KO1 from the key code demultiplexing circuit is larger than the code *N1–*KO1 stored in the latch circuit 145, the comparison circuit 143 applies the signal "1" to an OR circuit 146. The output of the OR circuit 146 is supplied through an AND circuit 147 to the strobe input (S) of the latch circuit 145. Applied to the other input of the AND circuit 147 is the pulse 3Y1. The signal CL1 from the delay flip-flop 126 (FIG. 3) is applied through a delay flip-flop 148 to the other input of the OR circuit 146.

The signal CL1 is produced as shown in the part (i) of FIG. 4. Therefore, by delaying the signal CL1 by 3 bit-times, the signal "1" is outputted by the delay flip-flop 148 at the time slots 6, 7 and 8, and is applied through the OR circuit to the AND circuit 147. Therefore, at the time slot 7 when the pulse 3Y1 is produced, the signal "1" is outputted by the AND circuit 147, and the latch circuit 145 stores the code N1–KO1 applied to its data input (D). This is the code N1–KO1 of the note assigned to the first channel ch1. Thus, initially, the code N1–KO1 of the note assigned to the channel ch1 is stored in the latch circuit.

When the code N1–KO1 of the channel ch2 appears, the code is compared with the code *N1–*KO1 of the channel ch1 stored in the latch circuit 145. When A>B, then the code *N1–*KO1 stored in the latch circuit is rewritten into that of the channel ch2. If A>B is not established, the code *N1–*KO1 in the latch circuit 145 is not rewritten, or maintained unchanged. In a manner as described above, the codes N1–KO1 of the channels are compared with the code *N1–*KO1 stored in the latch circuit 145, and the larger one is newly stored in the latch circuit 145.

Thus, the code *N1–*KO1 which is stored in the latch circuit 145 at the time slot 25 when comparison of the code N1–KO1 of the last channel ch7 has been completed, is the code of the highest note. The timing of occurrence of the code *N1–*KO1 of the highest note is as indicated in the part (m) of FIG. 4.

The output *N1–*KO1 of the latch circuit 145 is applied to a highest note storing section 149. The operation of the section 149 is similar to that of a latch circuit having eight latch positions. The highest note storing section 149 comprises: eight flip-flops; AND circuits for holding the memories of the flip-flops; AND circuits for rewriting the memories of the flip-flops; and OR circuits for inputting the outputs of these AND circuits to the flip-flops. The key-on signal KO1 stored in the latch circuit 145, the completion signal SPF from the shift register 135 (FIG. 3) and the pulse 3Y1 are applied to a memory controlling AND circuit 151. When the output of the AND circuit 151 is raised to "1", the highest note code *N1–*KO1 stored in the latch circuit 145 is written into the highest note storing section 149. When the output of the AND circuit 151 is set to "0", the content of the storing section 149 is self-maintained.

The completion signal SPF is produced as indicated in the part (k) of FIG. 4. As is clear from the parts (d), (k) and (m) of FIG. 4, the highest note's code *N1–*KO1 is accurately written into the section 149 at the time slot 25. When the code *N1–*KO1 stored in the latch circuit 145 is of the note of a key released, the data *KO1 is at "0", and therefore the AND circuit 151 is disabled, so that the content of the highest note storing section 149 is not rewritten. The code stored in the section 149 is applied to the input (B) of the comparison circuit 144. The comparison circuit 144 provides an output when A=B. That is, when the highest note's code stored in the highest note storing section 149 coinciees with the code N1–KO1 of a note assigned to a channel, the output of the comparison circuit 144 is raised to "1". The output "1" of the comparison circuit 144 is applied, as a highest note channel detection signal TCH, to the twin mallet control section 16.

Octaves multiplexed signal generating section

In this example, the octaves multiplexed signal generating section 29 (FIG. 1) is employed as means for generating tone source clock signals for the musical tone generating circuit 15. This section 29 (the detailed illustration being omitted) has twelve (12) octaves multiplexed signal generating circuits provided respectively for twelve notes (C# through C). The outputs of the octaves multiplexed signal generating circuits for the notes (C# through C) are designated by 29C#, 29D, . . . 29B and 29C in FIG. 1, respectively. In FIG. 1, reference character 29CL1 designates an output line on which the signal of note C lower by one octave than the signal of note C on a line 29C is provided.

On the output lines 29C# through 29C, there appear in time-division multiplex manner in a series mode a plurality of octave-related signals as would otherwise be obtained by successively frequency-dividing the clock signal of the note. The frequencies of the octave-related signals delivered in a series mode to each line have a relation of the n-th power of two (a relation of octave). Therefore, the signals on a line (each of 29C#–29CL) are binary data consisting of plural bits which are produced in a series mode. Such an octaves multiplexed signal generating section as described above is disclosed in detail in the specification of U.S. Pat. No. 4,228,403.

Figures 7, 8:
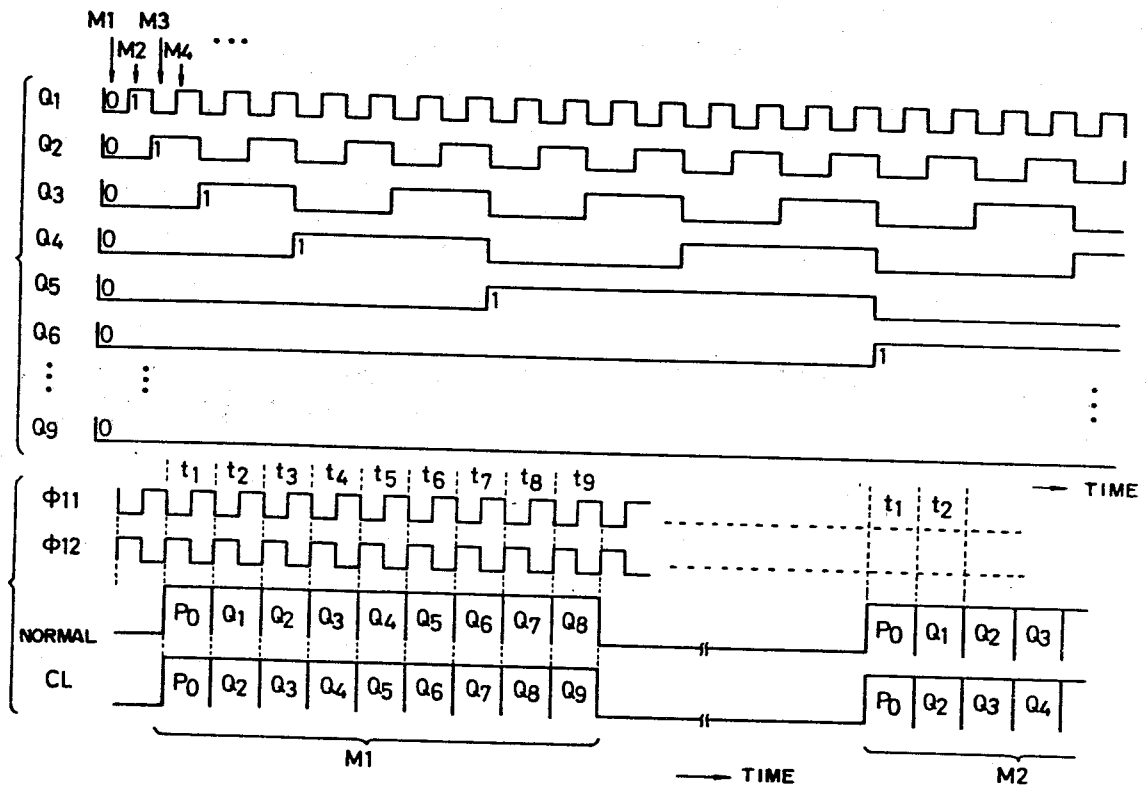
FIG. 7 is a timing chart showing tone signals produced by an octaves multiplexed signal generator in FIG. 1.
FIG. 8 is also a timing chart showing how the octave related signals are converted into serially aligned signals in the octaves multiplexed signal generator.

Among a plurality of octave related signals Q1 through Q9 the relation of which is such that the highest frequency of the note is successively frequency-divided (the signals Q1 through Q9 being in octave relation), the signal Q1 is highest in frequency. Whenever the amplitude level of at least the signal Q1 is inverted (flipped), data representative of the amplitude levels ("1" or "0") of the signals Q1 through Q9 are delivered one after another, in a series mode, to each of the lines 29C# through 29CL of the octaves multiplexed signal generating section 29. FIG. 7 shows the signals Q1 through Q9 for a certain note, which are generated in the octaves multiplexed signal generating section. If the weight of the signal Q1 is $2^0=1$, then the weight of the signal Q2 is $2^1$, the weight of the signal Q3 is $2^2$, and so forth as a digital number. In FIG. 7, reference characters M1, M2, M3, M4, . . . designate the timing of delivering the octaves related signals in a series mode.

FIG. 8 is to show a delivery timing (for instance M1) in detail. One delivery timing consists of nine time slots t1 through t9. The width of one time slot is determined by tone source master clock pulses $\phi 11$ and $\phi 12$. The frequency of the master clock pulses $\phi 11$ and $\phi 12$ is is much higher than the highest frequency of each note, and is normally equal to that of the clock pulses $\phi 1$ and $\phi 2$. However, in the case of a vibrato effect, the frequency of the master clock pulses is varied reciprocally and periodically at a frequency of vibrato. When the amplitude level of the signal Q1 is turned to "1" (or "0"), the time slot t1 starts first. In the time slot t1, a basic timing signal P0 is delivered. The basic timing signal P0 is at "1". For a period of time of at least eight time slots before the time slot t1, no signal is delivered to a relevant line (for instance 29C) of the octaves multiplexed signal generating section 29. Therefore, if a signal "1" appears on the output line (29C) after eight times slots having signals "0" occur successively, it means that the signal is the basic timing signal P0 and the time slot t1 occurs.

The time slot t2 next to the time slot t1 is assigned to deliver data representative of the logic level of the signal Q1 having the highest frequency. Data representative of the logical levels of the frequency division signals Q2 through Q8 are assigned to the time slots t3 through t9, respectively. After the time slot t9 is over, an output line (29C) is maintained at "0" until the next data delivery timing occurs.

For the other notes, the data P0, Q1, Q2, Q3, . . . and Q8 are delivered in a series mode to the output lines 29C# through 29B in the stated order. For note C, there is provided an output line 29CL. A series frequency division data P0, Q2, Q3, . . . and Q9 for the note C of the lowest octave is delivered to the output line 29CL. The weight of this data Q2 through Q9 is a half (½) of that of the data Q1 through Q8 which is delivered through the output line 29C of the ordinary note C; that is, the former is lower by one octave than the latter.

The octaves multiplexed data (series time division data) P0, Q1–Q8 or P0, Q2–Q9 corresponding to the notes, which are outputted by the octaves multiplexed generating section 29, are supplied through the output-lines 29C# through 29C and 29CL to the musical tone generating circuit 15.

Outline of the musical tone generating circuit

Figure 9:
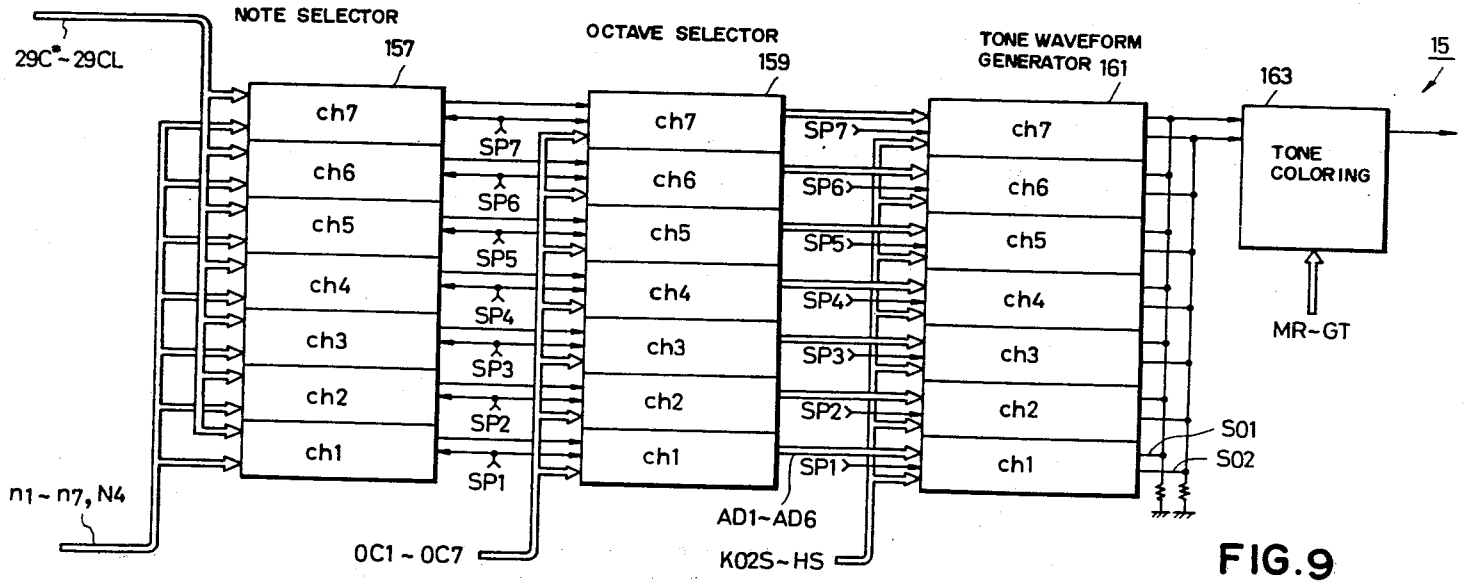
FIG. 9 is a block diagram showing one example of the internal arrangement of a musical tone generating circuit in FIG. 1.

FIG. 9 shows one example of the musical tone generating circuit 15. The circuit has seven tone production channels ch1 through ch7 in parallel. More specifically, the circuit 15 comprises a note selector 157, an octave selector 159 and a musical tone waveform generating section 161 for each channel, and a tone coloring circuit 163. The octaves multiplexed data corresponding to the notes are supplied through the output lines 29C#, 29D, 29D#, . . . 29B, 29C and 29CL of the above-described octaves multiplexed signal generating section 29 to the note selectors 157 of the channels ch1 through ch7, and furthermore the note signals n1 through n7 from the decoder (FIG. 5) and the most significant bit N4 of the note code are applied to the note selectors 157. The control pulses SP1 through SP7 from the timing signal generating circuit 26 (FIG. 3) are applied to the note selector (157) channels ch1 through ch7, respectively. In the note selectors 157 of the channels ch1 through ch7, according to the control pulses SP1 through SP7, the note signal n1 through n7 and the most significant bit N4, the octaves multiplexed data corresponding to the notes of keys assigned to the channels are selected.

The octaves multiplexed data selected by the note selectors 157 are applied to the octave selectors 159 of the same channels, respectively. The control pulses SP1 through SP7 are applied respectively to the octave selector (159) channels ch1 through ch7, and furthermore the octave signals OC1 through OC7 from the decoder 118 (FIG. 5) are supplied respectively to the channels ch1 through ch7. In the octave selectors 159 of the channels, the octaves multiplexed data selected by the respective note selectors 157 are arranged in parallel and the bit positions of the data are shifted according to the octave signals OC1 through OC7, so that address signals for reading waveform memories are formed.

The musical tone waveform generating sections 161 of the channels ch1 through ch7 comprise musical tone waveform memories and switching circuits (envelope giving circuits), so that musical tone waveform sample point amplitudes are successively read out of the musical tone waveform memories according to the address signals AD1 through AD6 which are provided by the octave selector 159, and an envelope is given to a musical tone waveform signal according to control signals, etc.

The control pulses SP1 through SP7 are applied to the musical tone waveform generating section (161) channels ch1 through ch7. Furthermore, the signals $\overline{GT}$ through HS from the tone color selecting section 17 (FIG. 1) and the signals KO2S and DS from the twin mallet control section 16 (FIG. 1) are applied to the musical tone waveform generating section (161) channels ch1 through ch7.

The note selectors and the octave selectors

Figure 10:
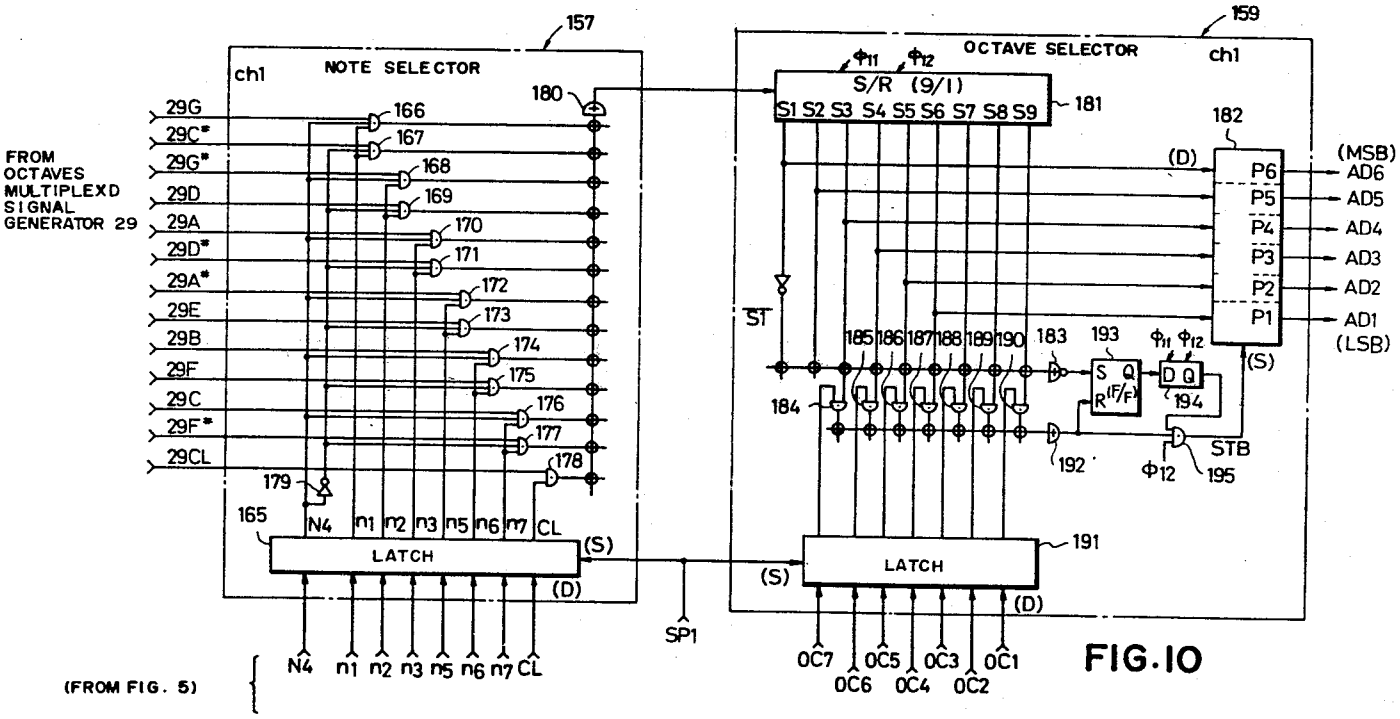
FIG. 10 is a detailed circuit diagram showing examples of an octave selector and a note selector in FIG. 9.

FIG. 10 shows the note selector and the octave selector of the first channel ch1 in detail. However, it should be noted that the remaining note selectors and octave selectors are similar to that shown in FIG. 10. The first channel ch1 will be described with reference to FIG. 10.

The note signals n1, n2, n3, n5 and n6 from the decoder 114 in the octave changing circuit 27 (FIG. 5), the note signal n7 supplied through the AND circuit 119, the signal CL representative of the lowest note C supplied through the NOR circuit 120, and the most significant bit N4 of the note code supplied by the latch circuit 34 (FIG. 3) are applied to a latch circuit 165 of the note selector 157. The control pulse SP1 from the AND circuit group 137 (FIG. 3) of the timing signal generating circuit 26 is applied to the strobe input (S) of the latch circuit 165 of the first channel ch1. The control pulse SP1 is generated in synchronization with the time slot 8 (FIG. 4). As was described before, the note code N1–N4, block code B1–B3 and key-on signals KO1 and KO2 of a note assigned to the first channel ch1 are outputted by the latch circuit 34 in the key code demultiplexing circuit 25 (FIG. 3) for a period of 3 μs corresponding to the time slots 6, 7 and 8. Therefore, with the timing of generation of the pulse SP1, the signals n1–n7, N4 and CL representative of the note assigned to the first channel ch1 are latched by the latch circuit 165. The function of the latch circuit 165 is such that, among the signals n1–n7, N4 and CL of the channels which are supplied in time division manner with a time width of 3 μs, that of the respective channel is selected and converted into a continuous signal.

The output of the latch circuit 165 is applied to octaves multiplexed data selecting AND circuits 166 through 178. The octaves multiplexed data (P0, Q1–Q8) corresponding to the notes C# through C from the octaves multiplexed signal generating section 29 are applied through the lines 29C#, 29D, . . . 29B and 29C to the other inputs of the AND circuits 166 through 177 as shown in FIG. 10, respectively. The octaves multiplexed data (P0, Q2–Q9) corresponding to the lowest note C is applied through the line 29CL to the other input of the AND circuit 178. The most significant bit N4 of the note code outputted by the latch circuit 165 is applied to the AND circuits 166, 168, 170, 172, 174 and 176; that is, when the note assigned to the channel is one of the notes G, G#, A, A#, B and C, the signal "1" is applied to these AND circuits 166, 168, 170, 172, 174 and 176. A signal obtained by inverting the output signal N4 of the latch circuit 165 by an inverter 179 is applied to the AND circuits 167, 169, 171, 173, 175 and 177; that is, when the note assigned to the channel is one of the notes C#, D, D#, E, F and F#, the signal "1" is applied to these AND circuits 167, 169, 171, 173, 175 and 177. The output signal n1 of the latch circuit 165 is applied to the AND circuits 166 and 167; the output signal n2, to the AND circuits 168 and 169; the output signal n3, to the AND circuits 170 and 171; the output signal n5, to the AND circuits 172 and 173; the output signal n6, to the AND circuits 174 and 175; and the output signal n7, to the AND circuits 176 and 177. Accordingly, among the AND circuits 166 through 177, only one AND circuit is enabled according to the combination of the note signals n1–n7 and the bit N4, whereby the octaves multiplexed data of one note is selected out of the octaves multiplexed data of twelve notes C# through C. The signal CL representative of the lowest note C outputted by the latch circuit 165 is supplied to the AND circuit 178. Therefore, when the lowest note C is assigned to the channel, the AND circuit 178 is enabled, and the octaves multiplexed data P0, Q2–Q9) only for the signal CL is selected. The outputs of the AND circuits 166 through 178 are supplied through an OR circuit 180 to a shift register 181 in the octave selector 159 of the respective channel (ch1 in this example).

The note selectors 157 of the channels ch1 through ch7 are different from one another only in that the pulses SP1 through SP7 are provided respectively for the channels ch1 through ch7 and are applied respectively to the strobe inputs (S) of the latch circuits 165. Accordingly, the note selectors of the channels ch1 through ch7 can select the octaves multiplexed data corresponding to the notes assigned to their own channels, respectively.

In the octave selector 159, the octaves multiplexed data (P0, Q1–Q8, or P0, Q2–Q9) of a single note selected by the respective note selector 157 is received, the data thus received is converted into a parallel data, and the bit position of the parallel data is suitably shifted according to the octave signal (OC1–OC7). The octaves multiplexed data P0, Q1–Q8 (or P0, Q2–Q9) supplied through the OR circuit 180 of the note selector 157 is inputted to the first stage S1 of a series-input parallel-output series-shift type 9-stage/1-bit shift register 181, and is successively shifted to the ninth stage S9. Accordingly, signals obtained by arranging in parallel the octaves multiplexed data P0, Q1–Q8 (or P0, Q2–Q9) are provided at the output terminals of the stages in the shift register 181. Since the octaves multiplexed data is supplied intermittently every timing of generation of the basis timing signal P0, the output data of the shift register 181 are latched by a latch circuit 182 so as to provide a continuous signal.

The data Q1–Q8 latched by the latch circuit 182 is used as an address signal to read a waveform stored in the musical tone waveform memory.

The shift register 181 is operated by the same clock pulses as the clock pulses $\phi 11$ and $\phi 12$ used in the octaves multiplexed signal generating section 29. The octaves multiplexed data is loaded in the order of P0, Q1, Q2, Q3, Q4, Q5, Q6, Q7 and Q8 into the shift register 181. The part (a) of FIG. 11 indicates the contents of the stages S1 through S9 of the shift register 181 for a period of time of from timing t1' to timing t9' with the top basic timing signal P0 loaded into the first stage S1 at timing t1'.

A signal $\overline{S1}$ obtained by inverting the output of the first stage S1 of the shift register 181, and the output signals of the second through ninth stages S2 through S9 are applied to a NOR circuit 183. The NOR circuit 183 operates to detect the basic timing signal P0 (i.e. the arrival of the frequency-division data Q1–Q8). The outputs of the third through ninth stages S3–S9 of the shift register 181 are applied to AND circuits 184 through 190, respectively. The function of the AND circuits 184 through 190 is such that the bit position of the frequency-division data Q1–Q8 (or Q2–Q9) arranged in parallel by the shift register 181 is shifted as much as corresponds to the octave signal (OC1–OC7). After being subjected to the shift control, the parallel octave related data Q1–Q8 (for Q2–Q9) are latched by the latch circuit 182.

The octave signals OC1 through OC7 supplied in time division manner by the octave changing circuit 27 in FIG. 5 are applied to the data input (D) of a latch circuit 191. Similarly as in the latch circuit 165 of the note selector 157, the pulse SP1 for the first channel ch1 is applied to the strobe input (S) of the latch circuit 191. It goes without saying that the pulses SP2 through SP7 for the remaining channels ch2 through ch7 are applied to the latch circuits 191 of the octave selectors 159 of the channels ch2 through ch7, respectively. When the octave signal (OC1–OC7, among which only one is at "1" and the remaining are at "0") of a note assigned to the first channel is inputted to the latch circuit 191, the pulse SP1 is produced, so that the octave signal (OC-1–OC7) of the note assigned to the first channel ch1 is latched by the latch circuit 191 of the channel ch1. Similarly, the octave signals OC1–OC7 of notes assigned to the remaining channels ch2 through ch7 are latched by the latch circuits 191 of the octave selectors of the channels ch2 through ch7, in response to the pulses SP2 through SP7, respectively.

The octave signals OC1 through OC7 latched by the latch circuit 191 are inputted to the AND circuits 184 through 190, beginning with the highest octave signal OC7. In this case, since among the octave signals OC1 through OC7, only one corresponding to the octave range of the note assigned to the relevant channel is raised to "1", only one of the AND circuits 184 through 190 which corresponds to the single octave signal (one of OC1–OC7) at "1" is enabled. When the basic timing signal PO is shifted to one of the stages S3 through S9 in the shift register 181, which corresponds to the AND circuit (one of 184–190) thus enabled, that AND circuit operates to apply a signal "1" to the OR circuit 192.

The arrival of the octaves multiplexed data Q1–Q8 (or Q2–Q9) to the shift register 181 is detected as follows:

The octave related data Q1–Q8 (or Q2–Q9) is delivered after the basic timing signal PO at all times. Therefore, no signal appears (being "0") for a period of time corresponding to at least 8 bit-times immediately before the provision of the basic timing signal PO. Thus, when the basic timing signal PO is loaded into the first stage S1 in the shift register 181, all of the outputs of the second through ninth stages representative of the signal state are at "0" for the 8 bit-times preceding the loading of the signal PO. This time instant is the timing t1′ in FIG. 11. As the basic timing signal PO is loaded into the first stage S1 of the shift register 181, the inversion output $\overline{S1}$ of the first stage S1 is set to "0". The first stage inversion output $\overline{S1}$ and the outputs of the second through ninth stages S2 through S9 are applied to the NOR circuit 183, and therefore the NOR circuit 183 provides an output "1" at the timing t1′.

Figure 11:
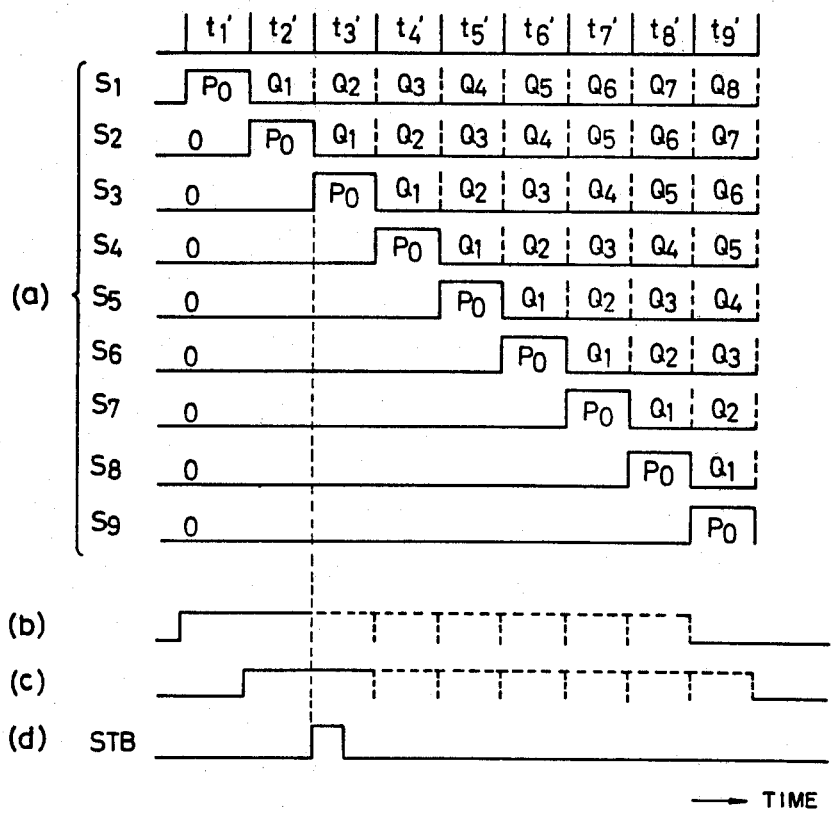
FIG. 11 is a timing chart for a description of the operation of the octave selector in FIG. 10.

The output of the NOR circuit 183 is applied to the set input (S) of a set-reset type flip-flop 193, as a result of which the flip-flop 193 is placed in set state as indicated in the part (b) of FIG. 11. The set output of the flip-flop, after being delayed by 1 bit-time by a delay flip-flop 194 as indicated in the part (c) of FIG. 11, is applied to an AND circuit 195 so as to enable the latter 195.

The outputs of the above-described AND circuits 184 through 190 are applied through an OR circuit 192 to the AND circuit 195 and to the reset input of the flip-flop 193. The basic timing signal PO appears before the data Q1–Q8 (or Q2–Q9) at all times. Therefore, when the output "1" is provided by the AND circuits 184 through 190 in response to the basic timing signal PO, an initial reset signal is applied to the flip-flop 193 to reset the latter 193. At the same time, the conditions of the AND circuit 195 are satisfied, and therefore the output "1" of the AND circuit 195 is supplied to the strobe input (S) of the latch circuit 182 with the timing of the clock pulse $\phi$12. The output of the delay flip-flop 194 is set to "0" one bit-time after the flip-flop 193 has been reset. Therefore, even if the output "1" is provided by the OR circuit 192 after that, the AND circuit 195 is not operated. Accordingly, the strobe pulse STB applied to the latch circuit 182 from the AND circuit 195 is provided only for one bit-time.

The timing of generation of the strobe pulse STB is determined by the octave signals OC1 through OC7.

First, in the case where the octave signal OC7 is at "1", when the basic timing signal PO is applied to the third stage S3 of the shift register 181, the AND circuit 184 is operated, and the strobe pulse STB is generated at the timing t3′ (FIG. 11,(*d*)). At the timing t3′, the data Q2 and Q3 are in the stages S1 and S2 of the shift register 181, respectively (FIG. 11,(*a*)). Therefore, these data Q2 and Q1 are loaded into the latch circuit 182.

The latch circuit 182 has six latch positions P1 through P6 (P6 corresponding to the weight of the most significant bit, and P1 to that of the least significant bit). The outputs of the first through sixth stages S1 through S6 of the shift register 181 are inputted to the latch positions P6 through P1 of the latch circuit 182. The outputs of the latch positions P1 through P6 of the latch circuit 182 are designated by reference characters AD1, AD2, AD3, AD4, AD5 and AD6, respectively (AD6 being the most significant bit and AD1 being the least significant bit).

The top of the octave related data Q1–Q8 (or Q2–Q9) is the data Q1 (or Q2). The basic timing signal PO is in the stage next to the stage where the data Q1 (or Q2) exists, in the shift register 181. The basic timing signal PO is to indicate the position timing of the octaves multiplexed data, and therefore it is unnecessary in the case where only the data Q1–Q8 (or Q2–Q9) are arranged in parallel and latched. However, in this example, the basic timing signal PO is also latched by the latch circuit 182. Thus, when the strobe pulse STB is provided at the timing t3′, the data Q2, Q1 and PO are latched in the latch positions P6, P5 and P4 of the latch circuit 182.

Whenever the octaves multiplexed data Q1–Q8 (or Q2–Q9) with the basic timing signal PO at the top is applied to the octave selector 159, the strobe pulse STB is provided to rewrite the contents of the latch circuit 182. The value of the output signal AD6–AD1 of the latch circuit 182 is changed whenever the logic values of the data Q1–Q8 (or Q2–Q9) are changed. Thus, the latch circuit 182 provides a binary signal AD6–AD1 whose bit positions are shifted according to the octave signal (OC1–OC7) with the frequency data Q1–Q8 (or Q2–Q9) maintained in parallel.

When the octave signal OC6 is at "1", the AND circuit 185 is enabled, whereby the strobe pulse STB is generated at the timing t4′ (FIG. 11). Similarly, the strobe signal STB is provided at the timing t5′ when the octave signal OC5 is at "1". The strobe signal STB is provided at the timing t6′ when the octave signal OC4 is at "1". The strobe signal STB is provided at the timing t7′ when the octave signal OC3 is at "1". The strove signal STB is provided at the timing t8′ when the octave signal OC2 is at "1". Finally, the strobe signal STB is provided at the timing t9′ when the octave signal OC1 is at "1".

Accordingly, the states of the octaves multiplexed data Q1–Q8 (or Q2–Q9) latched by the latch circuit 182 according to the octave signals OC1 through OC7, i.e. the states of the output signals AD6–AD1 of the latch circuit 182 are as indicated in the following Table 5.

TABLE 5

| Octave | | Latch Circuit 182 AD6 | AD5 | AD4 | AD3 | AD2 | (LSB) AD1 |
|---|---|---|---|---|---|---|---|
| (7th) | OC7 | Q2 | Q1 | "1" | "0" | "0" | "0" |
| (6th) | OC6 | Q3 | Q2 | Q1 | "1" | "0" | "0" |
| (5th) | OC5 | Q4 | Q3 | Q2 | Q1 | "1" | "0" |
| (4th) | OC4 | Q5 | Q4 | Q3 | Q2 | Q1 | "1" |
| (3rd) | OC3 | Q6 | Q5 | Q4 | Q3 | Q2 | Q1 |
| (2nd) | OC2 | Q7 | Q6 | Q5 | Q4 | Q3 | Q2 |
| (1st) | OC1 | Q8 | Q7 | Q6 | Q5 | Q4 | Q3 |
| (CL) | OC3 | Q7 | Q6 | Q5 | Q4 | Q3 | Q2 |
| | OC2 | Q8 | Q7 | Q6 | Q5 | Q4 | Q3 |
| | OC1 | Q9 | Q8 | Q7 | Q6 | Q5 | Q4 |

Musical tone waveform generating section

The musical tone waveform generating section 161 is illustrated in detail in FIG. 12. It should be noted that only the musical tone waveform generating section 161 for the first channel ch1 only is shown; however, those for the remaining channels ch2 through ch7 are similar to that in FIG. 12, except that the control pulses SP1 through SP7 for the channels ch1 through ch7 are applied to the strobe inputs (S) of latch circuits 240, respectively. The signals KO2S and DS from the twin mallet control section 16 are applied in time division manner to the two data inputs (D) of the latch circuit 240, so that the signals KO2S and DS of a note assigned to the respective channel are latched into a continuous signal.

In FIG. 12, the most significant bit AD6 of the addressed signal AD1–AD6 from the octave selector 159 of the same channel (ch1) is applied to an AND circuit 250, and the bits AD2 through AD6 are applied to a square wave conversion logic 249. The least five significant bits AD1 through AD5, and the output *AD6 of the AND circuit 250 are applied to an EXCLUSIVE OR circuit group 199 for Gray code conversion. A signal $\overline{MD}$ obtained by inverting the mandolin selection signal MD is applied from the tone color selecting section 17 (FIG. 1) to the other input of the AND circuit 250. Accordingly, the level of the output *AD6 of the AND circuit 250 is equal to the level of the bit AD6 when the tone colors (marimba, banjo and guitar) other than the mandolin tone color are selected. When the mandolin tone color is selected, the output of the AND circuit 250 is at "0".

The contents of octaves multiplexed data (Q1–Q9) forming a corrected address signal *AD6, AD5–AD1 are completely similar to those in Table 5 in the case where the tine colors other than the mandolin tone color are selected. In the case where the mandolin tone color is selected, all the data in the column "AD6" of Table 5 are at "0".

The 6-bit address signal *AD6, AD5–AD1 is repeatedly changed in correspondence to the addresses of from "0 0 0 0 0 0 (in decimal notation)" to "1 1 1 1 1 1 (63 in decimal notation)". The rate of this change is defined by the weight of the bits of the octaves multiplexed data Q1–Q8 assigned to the bits *AD6 (AD6) and AD5 through AD1 (i.e. the octave number, cf. Table 5) and the variation rate (i.e. the note frequency) of the octaves multiplexed data itself. As is clear from Table 5, some addresses are jumped with respect to the 4th (OC4) through 7th (OC7) octaves.

The EXCLUSIVE OR circuit group 199 consisting of five EXCLUSIVE OR circuits operates to convert the address signal *AD6, AD5–AD1 into a Gray code GC5–GC1. Adjacent bits of the address signal *AD6, AD5–AD1 are applied to each of the EXCLUSIVE OR circuits. The contents of 6-bit signals consisting of the Gray-coded signal GC1–GC5 and the signal *AD6 with respect to the octaves OC1 through OC7 are indicated in Table 6 below.

TABLE 6

| Octave | *AD6 MD = 0 | MD = 1 | GC5 MD = 0 | MD = 1 | GC4 | GC3 | GC2 | GC1 |
|---|---|---|---|---|---|---|---|---|
| 7th (OC7) | 0 | Q2 | Q1 | Q1⊕Q2 | $\overline{Q1}$ | 1 | 0 | 0 |
| 6th (OC6) | 0 | Q3 | Q2 | Q2⊕Q3 | Q1⊕Q2 | $\overline{Q1}$ | 1 | 0 |
| 5th (OC5) | 0 | Q4 | Q3 | Q3⊕Q4 | Q2⊕Q3 | Q1⊕Q2 | $\overline{Q1}$ | 1 |
| 4th (OC4) | 0 | Q5 | Q4 | Q4⊕Q5 | Q3⊕Q4 | Q2⊕Q3 | Q1⊕Q2 | $\overline{Q1}$ |
| 3rd (OC3) | 0 | Q6 | Q5 | Q5⊕Q6 | Q4⊕Q5 | Q3⊕Q4 | Q2⊕Q3 | Q1⊕Q2 |
| 2nd (OC2) | 0 | Q7 | Q6 | Q6⊕Q7 | Q5⊕Q6 | Q4⊕Q5 | Q3⊕Q4 | Q2⊕Q3 |
| 1st (OC1) | 0 | Q8 | Q7 | Q7⊕Q8 | Q6⊕Q7 | Q5⊕Q6 | Q4⊕Q5 | Q3⊕Q4 |

In Table 6, symbol ⊕ represents "an EXCLUSIVE OR logic". For instance "Q1⊕Q2", the value of the bit is determined by the EXCLUSIVE OR logic of the data Q1 and Q2. As is clear from Table 6, there are EXCLUSIVE OR logics of Q1 and "1" for the 4th through 7th octaves. The value of the EXCLUSIVE OR logic is represented by $\overline{Q1}$ (which is obtained by inverting the data Q1) because if the data Q1 is at "1", it is at "0", and if the data Q1 is at "0", it is at "1". Furthermore, the EXCLUSIVE OR logic of "1" and "0" is provided for the fifth through seventh octaves. This values is "1" at all times. The EXCLUSIVE OR logic value of "0" and "0" is "0" at all times. In addition, the signal *AD6 and the result GC5 of the EXCLUSIVE OR logic are varied as indicated in Table 6 depending on whether the data $\overline{MD}$ is at "0" or at "1".

The Gray-coded signals GC5 through GC1 and the most significant bit *AD6 of the address signal are applied to a gate section 200. The tone color control signal $\overline{TRIS}$ from the tone color selecting section 17 (FIG. 1) is applied to the gate control input of the gate section 200. When the signal $\overline{TRIS}$ is at "1", a signal on a gate control line 202 is raised to "1". As a result, relevant AND circuits are enabled, so that the highest five bits *AD6, GC5–GC2 are selected by the gate section 200 and are inputted to a decoder 201. When the signal $\overline{TRIS}$ is at "0", a signal "1" is applied through an inverter 248 to a gate control line 203. As a result, the least bits GC5–GC1 of a Gray-coded signal are selected by the gate section 200 and are applied to the decoder 201.

The decoder 201 decodes the 5-bit input into 32 individual output. The decode output is utilized to read data out of a musical tone waveform memory 205. The musical tone waveform memory 205 has a resistance type voltage division circuit and gates for obtaining outputs at the voltage division points V0 through V31 thereof, so that one of the gates is rendered conductive according to the output of the decoder 201, and a voltage at the voltage division point (V0–V31) concerning the gate is applied, as a musical tone waveform sample point amplitude voltage, to a line 206.

Only one kind of waveform is stored in the musical tone waveform memory 205; however, in this example, two kinds of waveforms (saw tooth waveforms and triangular waveforms) are selectively read out by changing the order of accessing the addresses (voltage division points V0–V31). The gate section 200 is provided for switching the kinds of waveforms read out of the musical tone waveform memory 205 from one to another, in such a manner that when the signal $\overline{TRIS}$ is at "1" the saw tooth waveform is selected, and when the signal is at "0", the triangular waveform is selected. The triangular waveform is obtained by reading data out of the musical tone waveform memory 205 with the aid of the Gray-coded signal GC5–GC1, while the saw tooth waveform can be obtained by reading data out of the memory 205 with the aid of the combination of the signal *AD6 and the most-significant-bit Gray code GC5–GC2.

The tone color control signal $\overline{TRIS}$ is provided by the NOR logic of the signals MR and $\overline{MD}$ in the tone color selecting section 17 (FIG. 1). Therefore, when the marimba tone color (MR) is selected, the signal $\overline{TRIS}$ is at "0", and therefore the triangular waveform is read out of the memory 205. When the banjo tone color (BJ) or the guitar tone color (GT) is selected, the signal $\overline{TRIS}$ is at "1", and therefore the saw tooth waveform is read out of the memory 205. In addition, when the mandolin tone color (MD) is selected, the saw tooth waveform is read out even if the signal $\overline{TRIS}$ is at "0" as described later.

One example of the waveforms stored in the musical tone waveform memory 205 is as shown in the part (a) of FIG. 13. An envelope waveform voltage (indicated by "−VEV") is applied to the voltage division circuit of the memory 205. In this example, the total number of addresses of the memory 205 is thirty-two (32). However, it should be noted that the order of arrangement of the output numerical values of the decoder 201 in order to read the sequential addresses (voltage division points V0–V31) is as 0, 1, 3, 2, 6, . . . 8, 24, 25, . . . 19, 17, and 16, not in the order of from 0 to 31. This staggered order of arrangement corresponds to the order of Gray-coded numbers.

A saw tooth waveform as shown in the part (b) of FIG. 13 can be obtained from the stored waveform shown in the part (a) of FIG. 13 by repeatedly reading data out of the musical tone waveform memory 205 in one direction (or by reading data out of the memory 205 according to the stored waveform). A triangular waveform as shown in the part (c) of FIG. 13 can be obtained by reading the sequential addresses (voltage division points V0–V31) in reciprocation manner.

As is apparent from Table 5, in the first through third octaves (OC1–OC3), the code advancement of the address signal *AD6(AD6)–AD1 is the same as that of an ordinary binary code. That is, all of the bits *AD6-(AD6)–AD1 are filled with the data Q1–Q8 (Q9). The possible states (binary code advancement) of the address signal *AD6(AD6)–AD1 in the first through third octaves (OC1–OC3), and the contents of the Gray-coded signal GC5–GC1 provided by the EXCLUSIVE OR circuit group 199 (FIG. 12) and of the data *AD6 are indicated with $\overline{MD}$="1" in Table 7.

TABLE 7

In case of OC1–OC3, with MD = "1"

| | AD6 | AD5 | AD4 | AD3 | AD2 | AD1 | Address in decimal notation | *AD6 | GC5 | GC4 | GC3 | GC2 | GC1 | Saw tooth waveform decoder output | Triangular waveform decoder output |
|---|---|---|---|---|---|---|---|---|---|---|---|---|---|---|---|
| | 0 | 0 | 0 | 0 | 0 | 0 | 0 | 0 | 0 | 0 | 0 | 0 | 0 | 0 | 0 |
| | 0 | 0 | 0 | 0 | 0 | 1 | 1 | 0 | 0 | 0 | 0 | 0 | 1 | 0 | 1 |
| | 0 | 0 | 0 | 0 | 1 | 0 | 2 | 0 | 0 | 0 | 0 | 1 | 1 | 1 | 2 |
| | 0 | 0 | 0 | 0 | 1 | 1 | 3 | 0 | 0 | 0 | 0 | 1 | 0 | 1 | 3 |
| | 0 | 0 | 0 | 1 | 0 | 0 | 4 | 0 | 0 | 0 | 1 | 1 | 0 | 3 | 6 |
| | 0 | 0 | 0 | 1 | 0 | 1 | 5 | 0 | 0 | 0 | 1 | 1 | 1 | 3 | 7 |
| | 0 | 0 | 0 | 1 | 1 | 0 | 6 | 0 | 0 | 0 | 1 | 0 | 1 | 2 | 5 |
| | 0 | 0 | 0 | 1 | 1 | 1 | 7 | 0 | 0 | 0 | 1 | 0 | 0 | 0 | 4 |
| | 0 | 0 | 1 | 0 | 0 | 0 | 8 | 0 | 0 | 1 | 1 | 0 | 0 | 6 | 12 |
| | 0 | 0 | 1 | 0 | 0 | 1 | 9 | 0 | 0 | 1 | 1 | 0 | 1 | 6 | 13 |
| | 0 | 0 | 1 | 0 | 1 | 0 | 10 | 0 | 0 | 1 | 1 | 1 | 1 | 7 | 15 |
| | 0 | 0 | 1 | 0 | 1 | 1 | 11 | 0 | 0 | 1 | 1 | 1 | 0 | 7 | 14 |
| | 0 | 0 | 1 | 1 | 0 | 0 | 12 | 0 | 0 | 1 | 0 | 1 | 0 | 5 | 10 |
| | 0 | 0 | 1 | 1 | 0 | 1 | 13 | 0 | 0 | 1 | 0 | 1 | 1 | 5 | 11 |
| (first | 0 | 0 | 1 | 1 | 1 | 0 | 14 | 0 | 0 | 1 | 0 | 0 | 1 | 4 | 9 |
| half) | 0 | 0 | 1 | 1 | 1 | 1 | 15 | 0 | 0 | 1 | 0 | 0 | 0 | 4 | 8 |
| Half | 0 | 1 | 0 | 0 | 0 | 0 | 16 | 0 | 1 | 1 | 0 | 0 | 0 | 12 | 24 |
| period | 0 | 1 | 0 | 0 | 0 | 1 | 17 | 0 | 1 | 1 | 0 | 0 | 1 | 12 | 25 |
| | 0 | 1 | 0 | 0 | 1 | 0 | 18 | 0 | 1 | 1 | 0 | 1 | 1 | 13 | 27 |
| | 0 | 1 | 0 | 0 | 1 | 1 | 19 | 0 | 1 | 1 | 0 | 1 | 0 | 13 | 26 |
| | 0 | 1 | 0 | 1 | 0 | 0 | 20 | 0 | 1 | 1 | 1 | 1 | 0 | 15 | 30 |
| | 0 | 1 | 0 | 1 | 0 | 1 | 21 | 0 | 1 | 1 | 1 | 1 | 1 | 15 | 31 |
| | 0 | 1 | 0 | 1 | 1 | 0 | 22 | 0 | 1 | 1 | 1 | 0 | 1 | 14 | 29 |
| | 0 | 1 | 0 | 1 | 1 | 1 | 23 | 0 | 1 | 1 | 1 | 0 | 0 | 14 | 28 |
| | 0 | 1 | 1 | 0 | 0 | 0 | 24 | 0 | 1 | 0 | 1 | 0 | 0 | 10 | 20 |

TABLE 7-continued

In case of OC1–OC3, with MD = "1"

| | AD6 | AD5 | AD4 | AD3 | AD2 | AD1 | Address in decimal notation | *AD6 | GC5 | GC4 | GC3 | GC2 | GC1 | Saw tooth waveform decoder output | Triangular waveform decoder output |
|---|---|---|---|---|---|---|---|---|---|---|---|---|---|---|---|
| | 0 | 1 | 1 | 0 | 0 | 1 | 25 | 0 | 1 | 0 | 1 | 0 | 1 | 10 | 21 |
| | 0 | 1 | 1 | 0 | 1 | 0 | 26 | 0 | 1 | 0 | 1 | 1 | 1 | 11 | 23 |
| | 0 | 1 | 1 | 0 | 1 | 1 | 27 | 0 | 1 | 0 | 1 | 1 | 0 | 11 | 22 |
| | 0 | 1 | 1 | 1 | 0 | 0 | 28 | 0 | 1 | 0 | 0 | 1 | 0 | 9 | 18 |
| | 0 | 1 | 1 | 1 | 0 | 1 | 29 | 0 | 1 | 0 | 0 | 1 | 1 | 9 | 19 |
| | 0 | 1 | 1 | 1 | 1 | 0 | 30 | 0 | 1 | 0 | 0 | 0 | 1 | 8 | 17 |
| | 0 | 1 | 1 | 1 | 1 | 1 | 31 | 0 | 1 | 0 | 0 | 0 | 0 | 8 | 16 |
| | 1 | 0 | 0 | 0 | 0 | 0 | 32 | 1 | 1 | 0 | 0 | 0 | 0 | 24 | 16 |
| | 1 | 0 | 0 | 0 | 0 | 1 | 33 | 1 | 1 | 0 | 0 | 0 | 1 | 24 | 17 |
| | 1 | 0 | 0 | 0 | 1 | 0 | 34 | 1 | 1 | 0 | 0 | 1 | 1 | 25 | 19 |
| | 1 | 0 | 0 | 0 | 1 | 1 | 35 | 1 | 1 | 0 | 0 | 1 | 0 | 25 | 18 |
| | 1 | 0 | 0 | 1 | 0 | 0 | 36 | 1 | 1 | 0 | 1 | 1 | 0 | 27 | 22 |
| | 1 | 0 | 0 | 1 | 0 | 1 | 37 | 1 | 1 | 0 | 1 | 1 | 1 | 27 | 23 |
| | 1 | 0 | 0 | 1 | 1 | 0 | 39 | 1 | 1 | 0 | 1 | 0 | 1 | 26 | 21 |
| | 1 | 0 | 0 | 1 | 1 | 1 | 39 | 1 | 1 | 0 | 1 | 0 | 0 | 26 | 20 |
| | 1 | 0 | 1 | 0 | 0 | 0 | 40 | 1 | 1 | 1 | 1 | 0 | 0 | 30 | 28 |
| | 1 | 0 | 1 | 0 | 0 | 1 | 41 | 1 | 1 | 1 | 1 | 0 | 1 | 30 | 29 |
| | 1 | 0 | 1 | 0 | 1 | 0 | 42 | 1 | 1 | 1 | 1 | 1 | 1 | 31 | 31 |
| | 1 | 0 | 1 | 0 | 1 | 1 | 43 | 1 | 1 | 1 | 1 | 1 | 0 | 31 | 30 |
| | 1 | 0 | 1 | 0 | 0 | 0 | 44 | 1 | 1 | 1 | 0 | 1 | 0 | 29 | 26 |
| | 1 | 0 | 1 | 1 | 0 | 1 | 45 | 1 | 1 | 1 | 0 | 1 | 1 | 29 | 27 |
| (second | 1 | 0 | 1 | 1 | 1 | 0 | 46 | 1 | 1 | 1 | 0 | 0 | 1 | 28 | 25 |
| half) | 1 | 0 | 1 | 1 | 1 | 1 | 47 | 1 | 1 | 1 | 0 | 0 | 0 | 28 | 24 |
| Half | 1 | 1 | 0 | 0 | 0 | 0 | 48 | 1 | 1 | 1 | 0 | 0 | 0 | 28 | 8 |
| period | 1 | 1 | 0 | 0 | 1 | 0 | 50 | 1 | 0 | 1 | 0 | 0 | 1 | 20 | 9 |
| | 1 | 1 | 0 | 0 | 1 | 0 | 50 | 1 | 0 | 1 | 0 | 1 | 1 | 21 | 11 |
| | 1 | 1 | 0 | 0 | 1 | 1 | 51 | 1 | 0 | 1 | 0 | 1 | 0 | 21 | 10 |
| | 1 | 1 | 0 | 1 | 0 | 0 | 52 | 1 | 0 | 1 | 1 | 1 | 0 | 23 | 14 |
| | 1 | 1 | 0 | 1 | 0 | 1 | 53 | 1 | 0 | 1 | 1 | 1 | 1 | 23 | 15 |
| | 1 | 1 | 0 | 1 | 1 | 0 | 54 | 1 | 0 | 1 | 1 | 0 | 1 | 22 | 13 |
| | 1 | 1 | 0 | 1 | 1 | 1 | 55 | 1 | 0 | 1 | 1 | 0 | 0 | 22 | 12 |
| | 1 | 1 | 1 | 0 | 0 | 0 | 56 | 1 | 0 | 0 | 1 | 0 | 0 | 18 | 4 |
| | 1 | 1 | 1 | 0 | 0 | 1 | 57 | 1 | 0 | 0 | 1 | 0 | 1 | 18 | 5 |
| | 1 | 1 | 1 | 0 | 1 | 0 | 58 | 1 | 0 | 0 | 1 | 1 | 1 | 19 | 7 |
| | 1 | 1 | 1 | 0 | 1 | 1 | 59 | 1 | 0 | 0 | 1 | 1 | 0 | 19 | 6 |
| | 1 | 1 | 1 | 1 | 0 | 0 | 60 | 1 | 0 | 0 | 0 | 1 | 0 | 17 | 2 |
| | 1 | 1 | 1 | 1 | 0 | 1 | 61 | 1 | 0 | 0 | 0 | 1 | 1 | 17 | 3 |
| | 1 | 1 | 1 | 1 | 1 | 0 | 62 | 1 | 0 | 0 | 0 | 0 | 1 | 16 | 1 |
| | 1 | 1 | 1 | 1 | 1 | 1 | 63 | 1 | 0 | 0 | 0 | 0 | 0 | 16 | 0 |

In case of reading the triangular waveform, the Gray-coded signal GC5–GC1 is selected, and is inputted to the decoder 201, as was described before. The outputs of the decoder 201 in this operation are as shown in the column "Triangular Waveform" of Table 7.

As is clear from Table 7, while the 6-bit binary address signal *AD6–AD1 is increased successively from the minimum value (0 0 0 0 0 0) to the maximum value (1 1 1 1 1 1), the 5-bit Gray-coded signal GC5–GC1 repeats the same data once in reciprocation manner. More specifically, while the value of the binary address signal *AD6–AD1 is changed from "0 0 0 0 0 0" to "1 1 1 1 1 1" (31 in decimal notation), the Gray-coded signal GC5–GC1 changes (if interpreted from ordinary binary code rule) in the order of 0, 1, 3, 2, 6, . . . 17 and 16 (cf. the column "Triangular Waveform" in Table 7) in the forward direction (V0→V31) of address order of the waveform memory 205; however, while the value of the binary address signal *AD6–AD1 is increased from "1 0 0 0 0 0" (32 in decimal notation) to "1 1 1 1 1 1" (63 in decimal notation) as indicated in Table 7 (2/2), the Gray-coded signal GC5–GC1 changes in the order of 16, 17, . . . 6, 2, 3, 1 and 0 in the reverse direction (V31→V0) of address order of the waveform memory 205. Accordingly, while the binary address signal *AD6–AD1 of modulo 64 increases from 0 in decimal notation to 63 in decimal notation, the waveform (FIG. 13,(*a*)) stored at the voltage division points V0 through V31 of the waveform memory 205 is read out once in reciprocation manner, whereby one period triangular waveform is read out as shown in the part (c) of FIG. 13.

In the case where the saw tooth waveform is read out, the signals *AD6 and GC5–GC2 are selected and are applied to the decoder 201. The outputs of the decoder 201, in this operation are as indicated in the column "Saw Tooth Waveform" of Table 7. As is clear from the column "Saw Tooth Waveform", while the binary address signal *AD6–AD1 changes from from 0 to 63, the output of the decoder 201 changes thirty-two (32) times (or has thirty-two different values), in which the same value occurs successively twice. The order of occurrence of the thirty-two different decoder outputs is the same as that of the advancement order 0, 1, 3, 2, 6, 7, . . . 8, 24, 25, . . . 19, 17 and 16 of the Gray code. Thus, the amplitude voltage of the same address is read successively twice out of the musical tone waveform memory 205; however, the reading order is of the forward direction from the voltage division point V0 to the voltage division point V31. Accordingly, while the binary address signal *AD–AD1 increases from 0 to 63, one period saw tooth waveform is read out of the waveform memory 205 as shown in the part (b) of FIG. 13.

As is apparent from Table 5 described before, in the fourth through seventh octaves, the address signal *AD6(AD6)–AD1 is incomplete in code advancement, some lower bits being fixedly at "0" or "1". Therefore, as indicated in Table 6, predetermined lower bits of the Gray-coded signal GC5–GC1 include one which is fixedly at "1" or "0", or one ($\overline{Q1}$) which exhibits "1" and "0" repeatedly. Thus, in the fourth through seventh octaves, as the octave increases, the sample point amplitudes of the stored waveform are read out at intervals. Furthermore, in the case of a triangular waveform, the same addresses are not read in return; that is, the reading in the reverse direction is carried out in such a manner that the addresses which have not been read in the forward direction are read. As the octave increases, the (maximum) amplitude of the waveform is decreased; however, the base voltage of the amplification is maintained unchanged. The advancement state of the code *AD6, GC5–GC1 in the cases of fourth through seventh octaves (OC4–OC7) is not described; however, it can be readily estimated from Table 7.

In the case where the mandolin tone color is selected, (i.e. $\overline{MD}$="0"), as is clear from Table 6 the data *AD6 is at "0" at all times and the value of the most significant bit GC5 of the Gray code signal is equal to the value of the fifth bit AD5 of the address signal. The lower bits GC4–GC1 of the Gray code signal are equal in code advancement to those GC4–GC1 in Table 7, GC5 being equal to AD5. In the case of $\overline{MD}$="0", $\overline{TRIS}$="0", and therefore the Gray code signal GC5–GC1 is selected by the gate section 200 so as to be inputted to the decoder 201. The advancement state of the Gray code signal GC5–GC1 in the cases of octaves OC1 through OC3 with $\overline{MD}$="0" is indicated in Table 8.

TABLE 8

| In the case of OC1–OC3, with $\overline{MD}$ = "0" | | | | | | |
|---|---|---|---|---|---|---|
| Address in decimal notation | GC5 | GC4 | GC3 | GC2 | GC1 | Output of decoder 201 |
| 0 | 0 | 0 | 0 | 0 | 0 | 0 |
| 1 | 0 | 0 | 0 | 0 | 1 | 1 |
| 2 | 0 | 0 | 0 | 1 | 1 | 3 |
| 3 | 0 | 0 | 0 | 1 | 0 | 2 |
| . | . | . | . | . | . | . |
| . | . | . | . | . | . | . |
| . | . | . | . | . | . | . |
| . | . | . | . | . | . | . |
| . | . | . | . | . | . | . |
| 15 | 0 | 0 | 1 | 0 | 0 | 8 |
| 16 | 1 | 1 | 0 | 0 | 0 | 24 |
| 17 | 1 | 1 | 0 | 0 | 1 | 25 |
| . | . | . | . | . | . | . |
| . | . | . | . | . | . | . |
| . | . | . | . | . | . | . |
| . | . | . | . | . | . | . |
| . | . | . | . | . | . | . |
| 30 | 1 | 0 | 0 | 0 | 1 | 17 |
| 31 | 1 | 0 | 0 | 0 | 0 | 16 |
| 32 | 0 | 0 | 0 | 0 | 0 | 0 |
| 33 | 0 | 0 | 0 | 0 | 1 | 1 |
| 34 | 0 | 0 | 0 | 1 | 1 | 3 |
| 35 | 0 | 0 | 0 | 1 | 0 | 2 |
| . | . | . | . | . | . | . |
| . | . | . | . | . | . | . |
| . | . | . | . | . | . | . |
| . | . | . | . | . | . | . |
| . | . | . | . | . | . | . |
| 62 | 1 | 0 | 0 | 0 | 1 | 17 |

TABLE 8-continued

| In the case of OC1–OC3, with $\overline{MD}$ = "0" | | | | | | |
|---|---|---|---|---|---|---|
| Address in decimal notation | GC5 | GC4 | GC3 | GC2 | GC1 | Output of decoder 201 |
| 63 | 1 | 0 | 0 | 0 | 0 | 16 |

As is apparent from Table 8, while the binary address signal AD6–AD1 increases from 0 to 63, the decoder 201 for decoding in a binary rule the Gray code signal GC5–GC1 provides the same outputs 0, 1, 3, 2, . . . 8, 24, 25, . . . 17 and 16 (in the forward direction) twice. Thus, in the case of the mandolin tone color, the saw tooth waveform instead of the triangular waveform is read at a twice frequency out of the waveform memory 205 even with $\overline{TRIS}$="0".

The musical tone waveform generating section 161 in FIG. 12 is so designed that a square waveform is also generated. The data AD6 and AD5 of the address signal AD6–AD1 are applied to a NOR circuit 208; the data AD6, a signal $\overline{AD5}$ obtained by inverting the data AD5, and the data AD4 and AD3 are applied to a NOR circuit 209; and the outputs of the NOR circuits 208 and 209 are inputted to a NOR circuit 210, whereby a first square waveform SQW1 is obtained. The data AD6 is applied to an inverter 211, whereby a second square waveform SQW2 is provided. The data AD5 and AD4 are supplied to a NOR circuit 212; the data AD5, a signal $\overline{AD4}$ obtained by inverting the data AD4, and the data AD3 and AD2 are applied to a NOR circuit 213; and the outputs of these NOR circuits 212 and 213 are supplied to a NOR circuit 214, whereby a third square waveform 214 is provided.

The logic expression of the first square waveform SQW1 is:

$$\begin{aligned} SQW1 &= \overline{\overline{AD6 + \overline{AD5}} + \overline{AD6 + \overline{AD5}} + AD4 + AD3} \qquad (1) \\ &= (AD6 + AD5)\cdot(AD6 + \overline{AD5} + AD4 + AD3) \\ &= AD6\cdot(AD6 + \overline{AD5} + AD4 + AD3) \\ &\quad + AD5\cdot(AD6 + \overline{AD5} + AD4 + AD3) \\ &= (AD6\cdot AD6) + AD6\cdot(\overline{AD5} + AD4 + AD3) \\ &\quad + (AD5\cdot AD6) + (AD5\cdot\overline{AD5}) \\ &\quad + (AD5\cdot AD4) + (AD5\cdot AD3) \end{aligned}$$

In the above equation (1), AD6·AD6 is AD6. Therefore, as one solution of the equation (1) has AD6, the term $\{AD6\cdot(\overline{AD5}+AD4+AD3)+AD5\cdot AD6\}$ is meaningless. Furthermore, $AD5\cdot\overline{AD5}$ is "0", and therefore the equation (1) can be simplified as follows:

$$SQW1 = AD6 + (AD5\cdot AD4) + (AD5\cdot AD3) \qquad (2)$$

The data AD6 has a weight of $2^5=32$. Therefore, the term AD6 is at "1" for an interval of from "32" to "63" in one period (from "0" to "63" in decimal notation) of the 6-bit binary address signal AD6–AD1. On the other hand, the term (AD5·AD4) is at "1" for an interval of from "1 0 1 0 0" to "1 0 1 1 1"; i.e. from "20" to "23". Therefore, the square waveform SQW1 is at "0" while the binary address signal AD6–AD1 has values of from "0" to "19", and it is at "1" while the signal has values of from "20" to "63". If the time width of the square wave which is at "0" is twenty (20), then the time width of the square wave which is at "1" is forty-four (44). Thus, the square waveform SQW1 has a duty ratio of 5:11.

The logic expression of the second square waveform SQW2 is as follows:

$$SQW2=\overline{AD6} \quad (3)$$

Therefore, the square waveform SQW2 has a duty ratio of 1:1, and the frequency thereof is equal to the frequency of the first square waveform SQW1.

The logic expression of the third square waveform SQW3 is as follows:

$$\overline{SQW3=AD5+AD4+AD5+AD4+AD3+AD2} \quad (4)$$

Similarly as in the equation (1), the equation (4) can be simplified as follows:

$$SQW3=AD5+(AD4\cdot AD3)+(AD4\cdot AD2) \quad (5)$$

It is apparent from the equation (5) that the square waveform SQW3 has a duty ratio of 5:11 similarly as in the first square waveform SQW1. The weight of AD5 is $2^4=16$ which is a half ($\frac{1}{2}$) of the weight of AD6. Therefore, the frequency of the square waveform SQW3 is twice the frequency of the square waveform SQW1 or SQW2. (If SQW1 or SQW2 is of 8 foot register, the SQW3 is of 4 foot register; if SQW1 or SQW2 is of 16 foot register, then SQW3 is of 8 foot register.)

In FIG. 12, the square waveform SQW1 is applied to a switching circuit made up of field-effect transistors (hereinafter referred to merely as FET's when applicable) 251 and 252, and an envelope waveform is given to the waveform SQW1 by the envelope waveform voltage VEV on the line 253. The resultant square waveform SQW1 is applied to a line 254. The square waveforms SQW2 and SQW3 are applied to AND circuits 255 and 256, respectively, and one of them is selected according to whether the signal TRIS is at "1" or at "0". The waveform thus selected is applied to a switching circuit consisting of FET's 258 and 259, and an envelope waveform is given to the waveform (SQW2 or SQW3) by a voltage −VEV on a line 253. The resultant square waveform (SQW2 or SQW3) is supplied to a line 260.

The saw tooth waveform or triangle waveform read out of the musical tone waveform memory 205 is applied through a line 206 to FET's 261 and 262. The square waveform SQW1 supplied to the line 254 is inputted to an FET 263. The square waveform SQW2 or SQW3 applied to the line 260 is inputted to an FET 265. The output of the FET 261 is applied to the gate of an FET 266. The outputs of the FET's 262, 263 and 265 are supplied to the gate of an FET 267. The sources of the FET's 266 and 267 provide two kinds of musical tone signals SO1 and SO2, respectively. The musical tone signals SO1 and SO2 from the channels (ch1–ch7) of the musical tone waveform generating section 161 are applied to the tone coloring circuit 163 (FIG. 9).

A tone color control signal WS from the tone color selecting section 17 (FIG. 1) is applied to the gate of the FET 261. A signal SS from the tone color selecting section 17 (FIG. 1) is applied to the gate of the FET 263. Furthermore, a signal HS is supplied to the gate of the FET 265. The signals HS and SS are inverted by a NOR circuit 269 and are applied to the gate of the FET 262. As is clear from the circuitry of the tone color selecting section 17 (FIG. 1), the signal HS is raised to "1" when the mandolin tone color (MD) is selected, the signal SS is raised to "1" when the marimba (MR) or guitar (GT) tone color is selected, and the signal WS is set to "1" in all cases, i.e. when any of the tone colors MR, MD, BJ and GT is selected. Therefore, when the tone colors are selected, the signals WS, SS and HS are provided, the FET's 261 through 265 are rendered conductive, and the tone source waveforms on the lines 206, 254 and 260 are provided as the musical tone signals SO1 and SO2, as indicated in Table 9 below.

TABLE 9

| Tone color | HS | SS | WS | Conductive FET | SO1 | SO2 |
|---|---|---|---|---|---|---|
| MR GT | 0 | 1 | 1 | 261 263 | 206 | 254 |
| MD | 1 | 0 | 1 | 261 265 | 206 | 260 |
| BJ | 0 | 0 | 1 | 261 262 | 206 | 206 |

The tone source waveforms introduced to the lines 206 and 260 are different depending on the signal $\overline{TRIS}$. In the octave changing circuit 27 in FIG. 5, octave change is carried out according to the tone colors. If summarized, the tone source waveforms of the musical tone signals SO1 and SO2 are obtained in correspondence to the tone colors MR through GT as indicated in Table 10 below.

TABLE 10

| Tone color | SO1 | SO2 |
|---|---|---|
| Marimba (MR) | 8' TRI | 8' SQW1 |
| Mandolin (MD) | 4' SAW | 8' SQW2 |
| Banjo (BJ) | 16' SAW | 16' SAW |
| Guitar (GT) | 16' SAW | 16' SQW1 |

In Table 10, reference characters 4', 8' and 16' designate 4 foot, 8 foot and 16 foot registers, respectively; and SAW and TRI, the saw tooth waveform and the triangular waveform, respectively.

In FIG. 12, the envelope waveform voltage −VEV is provided by a capacitor 270. When an FET 271 is rendered conductive by the key-on signal KO2S which is latched by the latch circuit 240, the capacitor 270 is charged through an attack resistor r10 to a voltage −5 V. The key-on signal KO2S is at "1" for a very short period, at the start of producing tones, and when the signal KO2S is set to "0", the capacitor 270 begins to discharge. The capacitor 270 has discharge circuits. A first one of the discharge circuits is constituted by a resistor r11 and an FET 272, a second one by a resistor r12 and an FET 274, a third one by a resistance circuit in the waveform memory 205 coupled through the line 253 to the capacitor. The circuit of the resistor r12 and the FET 274 is used to quickly damp tones. An ordinary moderate damping curve (sustained curve) is formed by the circuit of the resistor r11 and the FET 272, or by the resistance circuit in the waveform memory 205.

The signal $\overline{GT}$ from the tone color selecting section 17 in FIG. 1 is supplied to the gate of the FET 272. Therefore, in the case where the tone colors MR, MD and BJ are selected, the FET 272 is rendered conductive, so that the capacitor 270 is discharged through the resistor r11. The resistance of the resistor r11 is, for instance, of the order of 37 KΩ. Therefore, the sustain time provided by the discharge is relatively short.

When the signal $\overline{GT}$ is at "0", i.e. the guitar tone color is selected, the FET 272 is rendered non-conductive (off), and accordingly the capacitor 270 is discharged substantially through the resistance circuit in the waveform memory 205. The resistance value of the resistance circuit is much larger than that of the resistor r11. Therefore, the sustain time provided by this discharge is relatively long.

Thus, the envelope waveform voltage −VEV for damping tone system (or percussive system) which, upon tone production, rises abruptly and thereafter falls moderately is provided by the capacitor 270. This voltage −VEV is applied to the line 253. In the case when tone production is quickly suspended, the signal latched by the latch circuit 240 is raised to "1" to render the FET 274 conductive (on). Therefore, the capacitor 270 is discharged quickly through the resistor r12, whereby the envelope waveform is abruptly eliminated.

Twin mallet trill performance

The twin mallet control section 16 is illustrated in detail in FIG. 14. A key-on memory section 275 is to store whether or not a key in the keyboard is depressed. A twin mallet tone production channel specifying circuit 276 is provided to specify a channel for twin mallet tone production. A repeat control circuit 277 concerns repeat tone production effects such as a twin mallet effect and a banjo repeat effect, and more particularly it is provided to set and control the repeat intervals of repeat tones. A signal generation logic 278 is provided to generate the key-on signal KO2S and the decay signal DS.

In the key-on memory section 275, the signal SPT (FIG. 4,(*l*)) representative of the delivery period of the key data of each channel is applied from the timing signal generating circuit 26 (FIG. 3) to one input terminal of an AND circuit 279, to the other input terminal of which the first key-on signal KO1 is applied from the latch circuit 34 (FIG. 3). The signal CL1 (FIG. 4,(*i*)) outputted by the delay flip-flop 126 (FIG. 3) is applied to an AND circuit 281 through an inverter 280.

When the signal CL1 is raised to "1" (time slots 3–5) the AND circuit 281 is disabled, to release the self-hold state of a delay flip-flop 282, which is driven by the two-phase clock pulses $\phi$A and $\phi$B (FIG. 4, (*e*) and (*f*)). The output of the delay flip-flop 282 is self-held through the AND circuit 281 and an OR circuit 283. At the time slot 6, the signal SPT is raised to "1" to enable an AND circuit 279. If the key-on signal KO1 is provided during this operation, it is applied through the AND circuit 279 and the OR circuit 283 to the delay flip-flop 282 so as to be stored therein. In other words, if at least one key is depressed in the key board, the first key-on signal KO1 is produced during the generation of the signal SPT and is stored in the delay flip-flop 282.

The output of the delay flip-flop 282 is applied to a latch circuit 284, where it is converted into a DC signal. Applied to the strobe input (S) of the latch circuit 284 is the output of an AND circuit 285. The signal CL1 and the pulse 3Y1 are applied to the AND circuit 285. The signal which is stored in the delay flip-flop 282 immediately before the latter is cleared with the timing of the signal CL1 is latched by the latch circuit 284.

Let us investigate the time slots 3, 4 and 5 (FIG. 4) in which the signal CL1 is provided. At the time slot 4 at which the pulse 3Y1 is provided, the signal stored in the delay flip-flop 282 is latched by the latch circuit 284. At the time slot 5 at which the pulse $\phi$A is produced, the signal "0" from the AND circuit 281 is applied to the delay flip-flop 282 to clear the content of the latter 282. At the time slot 6, the pulse $\phi$B is provided, so that the content "0" of the delay flip-flop 282 which has been cleared is read out.

If a key in the key board is being depressed, the output SAKO of the latch circuit 284 is maintained at "1". The output SAKO will be referred to as "an any-key-on signal" hereinafter. The output of the AND circuit 279 is representative of the timing (FIG. 4,(*h*)) of a channel to which a key being depressed is assigned. This output of the AND circuit 279 will be referred to as "a key-on channel signal KOCH" hereinafter. The signal KOCH is applied to AND circuits 286 and 287 in the twin mallet tone production channel specifying circuit 276.

The any-key-on signal SAKO outputted by the latch circuit 284 is inverted by an inverter 288, and the resultant signal $\overline{SAKO}$ is supplied to the signal generator logic 278 and the repeat control circuit 277.

In the signal generation logic 278, the second key-on signal KO2 from the latch circuit 34 (FIG. 3) is applied to an AND circuit 290, while the first key-on signal KO1 from the same latch circuit 34 is supplied to an AND circuit 297. The guitar selection signal GT from the tone color selecting section 17 (FIG. 1) is applied to the other input terminal of the AND circuit 290, while the banjo selection signal BJ is applied to the other input terminal of the AND circuit 297. The twin mallet selection signal TM is applied to one input terminal of an AND circuit 296, to the other input terminal of which a signal outputted by an AND circuit 286 in the twin mallet tone production channel specifying circuit 276 is applied. The outputs of these AND circuits 290, 296 and 297 are applied through an OR circuit 295 to one input terminal of an AND circuit 294, to the other input terminal of which is applied a repeat key-on signal RKO2 from the repeat control circuit 277. The output of the AND circuit 294 is supplied, as the key-on signal KO2S, to the musical tone waveform generating section 161 (FIG. 12). The inversion signal $\overline{SAKO}$ of the any-key-on signal SAKO is applied, as the decay signal DS, to the musical tone waveform generating section 161.

The twin mallet tone production channel specifying circuit 276 includes a plural-key-depression detecting circuit 300 which comprises: a delay flip-flop 304, a latch circuit 305; AND circuits 287, 308 and 309; and an OR circuit 307. The detecting circuit 300 operates to detect whether or not a plurality of keys are simultaneously depressed, with the aid of the key-on channel signal KOCH and the highest-note channel detection signal TCH. The highest-note channel detection signal TCH is provided by the particular note detecting circuit 28 (FIG. 6), and is applied to an inverter 306, the output of which is applied to the AND circuit 287. The signal TCH is raised to "1" with the timing of a channel to which the highest note is assigned. Therefore, a signal obtained by inverting the signal TCH, i.e. the output of the inverter 306 is raised to "1" with the timing of the channels other than the channel of the highest note. As the key-on channel signal KOCH is applied to the other input terminal of the AND circuit 287, the output of the AND circuit 287 is raised to "1" with the timing of the channel which is other than that of the highest note and is for depressed key. The fact that there is a channel which is other than that of the highest note and which is for depressed key, means that more than one key are depressed. Therefore, when more than one key are depressed in the keyboard, then a signal "1" is stored in the delay flip-flop 304 through the AND circuit 287 and the OR circuit 307. Upon provision of the signal CL1, the AND circuit 308 is disabled, so as to clear the content of the delay flip-flop 304. The signal stored in the delay flip-flop 304 is latched by the latch circuit 305. The output of the AND circuit 309 is applied to the strobe input terminal (S) of the latch circuit 305. The signal CL1 and the pulse 3Y1 are applied to the AND circuit 309. The output MKO of the latch circuit 305 is maintained at "1" when more than one key are depressed in the key board. The output MKO of the latch circuit 305 is supplied to an AND circuit 310. The output RPT of the AND circuit 310 is applied to one input terminal of an EXCLUSIVE OR circuit 311. The highest-note channel detection signal TCH is applied to the other input terminal of the EXCLUSIVE OR circuit 311, the output of which is applied to the AND circuit 286.

The repeat control circuit 277 includes a tempo oscillator 312, and a 6-bit counter 313 for counting clock pulses TCL generated by the tempo oscillator 312. The outputs Q1, $\overline{Q2}$, $\overline{Q3}$, $\overline{Q4}$, $\overline{Q5}$ and Q6 of the counter 313 are applied to an AND circuit 316, and simultaneously the twin mallet selection signal TM is applied to the AND circuit 316. Therefore, in the case where the twin mallet is selected, the conditions of the AND circuit 316 are satisfied whenever the value of the counter 313 reaches "1 0 0 0 0 1" (33 in decimal notation). The output of the AND circuit 316 is applied through an OR circuit 317 to the input terminal (T) of a ½-frequency-division flip-flop 318, and it is applied through an OR circuit 319 to the set input terminals (S) of the counter 313, which are provided for the bits, respectively.

Thus, in the case of twin mallet, when the count value of the counter 313 reaches "1 0 0 0 0 1", the content of the counter 313 is set to "1 1 1 1 1 1". The counting operation is effected with the value "1 1 1 1 1 1" as the initial value. Therefore, whenever thirty-three (33) clock pulses TCL are counted, a signal "1" (CHG) is provided through the AND circuit 316 and the OR circuit 317.

The outputs Q2, Q3, Q4, Q5 and Q6 of the counter 313 are applied to a NOR circuit 322, the output of which is the repeat key-on signal RKO2. When all of the outputs Q2–Q6 of the counter 313 are at "1", a signal "1" is provided by the NOR circuit 322. In other words, when the count value of the counter 313 is "0 0 0 0 0 0" (0 in decimal notation) or "0 0 0 0 0 1" (1 in decimal notation), the NOR circuit outputs the signal RKO2.

When the value of the counter 313 reaches 1 0 0 0 0 1", the value of the counter 313 is set to "1 1 1 1 1 1". Upon application of the first pulse TCL thereafter, the content of the counter is changed to "0 0 0 0 0 0", and the content is changed to "0 0 0 0 0 1" by the next pulse TCL. As the content of the counter is changed to "0 0 0 0 0 1" in succession with "0 0 0 0 0 0", the signal RKO2 provided by the NOR circuit 322 has a time width equal to two periods of the clock pulse TCL.

The output QRPT of the flip-flop 318 is changed from "0" to "1" or from "1" to "0" whenever the OR circuit 317 provides the signal "1" (CHG). The relations between the signals CHG, QRPT and RKO2 are as indicated in FIG. 15. The output QRPT of the flip-flop 318 is applied to the AND circuit 310. When the key depression is released, the signal SAKO is raised to "1", as a result of which the flip-flop 318 is reset, and the content of the counter 313 is set to the initial value, and oscillation of the tempo oscillation 312 is stopped.

The three states of twin mallet trill performance will be described.

(1) In the case where two keys are depressed simultaneously:

In this case, the output signal MKO of the plural-key-depression detecting circuit 300, which indicates that more than one key are depressed, is at "1", and the AND circuit 310 is enabled. Therefore, the output QRPT of the flip-flop 318 passes through the AND circuit 310, and the output RPT of the AND circuit has "1" and "0" alternately as in the signal QRPT in FIG. 15. The output of the EXCLUSIVE OR circuit 311 is raised to "1" with the generation timing of the signal TCH when the signal RPT (i.e. QRPT) is at "0". Furthermore, where the signal RPT (i.e. QRPT) is at "1", the output of the EXCLUSIVE OR circuit 311 is raised to "1" when no signal TCH is produced (TCH="0"). In some of the channels in which no signal TCH is produced, the key is not depressed. For this reason, the AND circuit 286 is opened by the key-on channel signal KOCH, so that only the output "1" of the EXCLUSIVE OR circuit 311 which is provided with the timing of the channel to which a key being depressed in the key-board is assigned is selected by the AND circuit 286.

Accordingly, while the signal QRPT is at "0", the output of the AND circuit 286 is raised to "1" with the timing of the channel to which the higher one (highest note) of the two depressed keys is assigned. This output "1" is applied through the AND circuit 296 and the OR circuit 295 to the AND circuit 294. Thus, in response to the repeat key-on signal RKO2 produced when the signal QRPT is at "0", the key-on signal KO2S is provided in time division manner with the timing of the channel to which the highest note is assigned.

When the signal QRPT is changed to "1" from "0", the output of the AND circuit 286 is raised to "1" with the timing of the channel to which the lower key is assigned. Therefore, while the second repeat key-on signal RKO2 is being produced, the key-on signal KO2S is provided in time division manner with the timing of the channel to which the lower note is assigned.

In the musical tone waveform generating section 161 (FIG. 12) for the channel (one of the channels ch1 through ch7) in which the signal KO2S is produced, this signal KO2S is converted into a DC signal which is utilized to control the FET 271. Therefore, the capacitor 270 is charged while the signal is being produced and it is then gradually discharged, so that a percussive envelope voltage is repeatedly provided on the line 253 (FIG. 12). Thus, in the switching circuit comprising the FET's 251 and 252, or in the switching circuit comprising the FET's 258 and 259, or in the resistance type voltage division circuit of the musical tone waveform memory 205, switching control (amplitude modulation) is effected according to the envelope waveform on the line 253.

It is assumed that the higher one (highest note) of the two keys is assigned to the second channel ch2. In this case, the musical tone is produced by the musical tone waveform generating section 161 (FIG. 9) of the channel ch2, when the signal QRPT is at "0". If the lower key is assigned to the first channel ch1, the musical tone is produced by the channel ch1 when the signal QRPT is at "1". As is apparent from the above description, two different tones are alternately produced.

(2) In the case where more than three keys are depressed:

Similarly as in the case of two-key depression described above, when the signal QRPT is at "0", the key-on signal KO2S is provided for the channel of the highest note (TCH), and the musical tone (highest note) is produced by the musical tone waveform generating section 161 of that channel. When the signal QRPT is at "1", the output of the EXCLUSIVE OR circuit 311 is raised to "1" in correspondence to the channel in which the signal TCH is at "0". Therefore, in this case, the output of the AND 286 is raised to "1" with the timing of the channels to which all the depressed keys except the highest note key are assigned. Thus, during the period of generation of the repeat key-on signal RKO2 which is generated when the signal QRPT is at "1", the key-on signals KO2S are provided in time division manner in correspondence to a plurality of channels to which a plurality of depressed keys except the highest note key are assigned. The key-on signals KO2S thus provided are distributed to the musical tone waveform generating sections 161 (FIG. 9) of the respective channels in response to the control pulses SP1 through SP7. Thus, the musical tones of the plural depressed keys except the highest note key are produced simultaneously in these channels. As is clear from the above description, the tone production of the highest note key and the simultaneous tone production of all the keys except the highest note key are effected alternately.

(3) In the case where only one key is depressed in the keyboard:

The signal MKO indicating the fact that more than one key is depressed is at "0", and the AND circuit 310 is disabled. Therefore, the signal RPT is at "0" at all times. The highest-note channel detection signal TCH is raised to "1" with the timing of the channel to which only one depressed key is assigned. Accordingly, the output of the EXCLUSIVE OR circuit 311 is raised to "1" with the timing of generation of the signal TCH, i.e. in correspondence to the channel of the only one depressed key. With the timing of the channel, the key-on channel signal KOCH is also raised to "1", and therefore the AND circuit 286 provides a signal "1" with the aid of the output "1" of the EXCLUSIVE OR circuit 311. This output "1" of the AND circuit 286 is applied through the AND circuit 296 which is enabled by the twin mallet selection signal TM and through the OR circuit 295 to the AND circuit 294. The signal which is applied through the OR circuit 295 to the AND circuit 294 is raised to "1" in time division manner in correspondence to the timing of the channel to which the only one depressed key is assigned. This time division channel signal is selected by the AND circuit 294 at the time of generation of the repeat key-on signal RKO2, whereby the key-on signal KO2S is produced in time division manner. This key-on signal KO2S is latched by the latch circuit 240 (FIG. 12) of the musical tone waveform generating section 161 (FIG. 9) corresponding to the channel (which is one of the channels ch1 through ch7) to which the depressed key is assigned. Thus, in the channel, whenever the repeat key-on signal RKO2 is produced, a musical tone with a percussive envelope is produced; that is, the tone of the only one key is repeatedly produced.

Modification of the twin mallet trill performance

In the arrangement shown in FIG. 14, the time interval in which the same tone is repeatedly produced in the case where a plurality of keys are depressed is different from that in the case where only one key is depressed. In other words, the first case where a plurality of keys are depressed is equal to the second case where only one key is depressed in the generation intervals of the repeat key-on signal RKO2; however, different tones are alternately produced in the first case, while the same tone is repeatedly produced in the second case. Thus, the time interval in which the same tone is repeatedly produced in the first case is twice as long as that in the second case.

The time interval in which the same tone is repeatedly produced in the case where a plurality of keys are depressed can be made to be equal to that in the case where only one key is depressed, by modifying the circuit shown in FIG. 14 into a circuit as shown in FIG. 16. FIG. 16 shows only the modified parts of the twin mallet control section 16 and the relevant circuits.

According to the modification shown in FIG. 16, the aforementioned object can be achieved merely by inserting a ½ frequency division flip-flop 330 and an AND circuit 331 between the tempo oscillator 312 and the counter 313. The clock pulse TCL from the tempo oscillator 312 is applied to the count input terminal (T) of the flip-flop 330. The output 2TCL of the flip-flop 330 is applied to one input terminal of the AND circuit 331, to the other input terminal of which is applied the clock pulse TCL. The output of the AND circuit 331 is applied to the count input terminal of the counter 313. The output signal MKO of the plural-key-depression detecting circuit 300 is supplied to the set input terminal (S) of the flip-flop 330.

In the case where a plurality of keys are depressed, the signal MKO is raised to "1" as described before, and the output 2TCL of the flip-flop 330 is maintained at "1" at all times. Therefore, the clock pulse TCL passes through the AND circuit 331 and it is counted by the counter 313.

In the case where only one key is depressed, the signal MKO is at "0", and the flip-flop 330 carries out its ½ frequency division operation. Therefore, the flip-flop 330 provides an output 2TCL whose frequency is a half (½) of the frequency of the input clock pulse TCL. The clock pulse TCL and the signal 2TCL whose period is twice that of the clock pulse TCL are applied to the AND circuit 331, and accordingly every other clock pulse TCL passes through the AND circuit 331. Thus, a pulse whose frequency is a half (½) of that of this clock pulse TCL is applied from the AND circuit 331 to the counter input terminal (T) of the counter 313.

Accordingly, the generation time interval of the repeat key-on signal RKO2 in the case where a plurality of keys are depressed is a half (½) of that in the case where only one key is depressed, and the time interval in which the same tone is repeatedly produced in the former case is equal to that in the latter case.

Shown in FIG. 17 is another modification of the circuit shown in FIG. 14, for achieving the same object. Similarly as in FIG. 16, FIG. 17 shows only modified parts of the twin mallet control section in FIG. 14 and the relevant circuits. In the modification in FIG. 17 unlike that in FIG. 16, the flip-flop 330 and the AND circuit 331 are not provided, and instead the clock pulse TCL is applied directly to the counter 313 similarly as in FIG. 14. Therefore, the time intervals of generation of the repeat key-on signal RKO2 are constant irrespective of the number of keys depressed. The arrangement of a twin mallet tone production channel specifying circuit 276' in FIG. 17 is greatly different from that of the twin mallet tone production channel specifying circuit 276 in FIG. 14; that is, no plural-key-depression detecting circuit 300 is provided and a circuit corresponding to the AND circuit 310 is not provided. These circuits eliminated are replaced by an EXCLUSIVE OR circuit 331'. The highest-tone channel detection signal TCH and the output QRPT of the flip-flop 318 are applied to the EXCLUSIVE OR circuit 311', the output of which is applied to one input terminal of an AND circuit 286. As was described with reference to FIG. 14, the key-on channel signal KOCH is applied to the other input terminal of the AND circuit 286. The output of the AND circuit 286 is supplied through the AND circuit 296 and the OR circuit 295 to the AND circuit 294.

As shown in FIG. 15, the level of the signal QRPT is changed from "0" to "0", or from "0" to "1", whenever the repeat key-on signal RKO2 is provided. While the signal QRPT is at "0", the EXCLUSIVE OR circuit 311' selects the highest-note channel detection signal TCH (TCH="1"), so that, as was described before, the tone of the highest note key among the plural depressed keys, or the tone of a single depressed key is produced. While the signal QRPT is at "1", the channels other than that of the highest note, i.e. the channels in which TCH="0" are selected by the EXCLUSIVE OR circuit 311'. Among these channels, the channels to which the depressed keys are assigned (i.e. the channels of the depressed keys except the highest note key) are selected by the AND circuit 286. Thus, with the aid of the repeat key-on signal RKO2 which is provided when the signal QRPT is at "1", the tones of the depressed keys except the highest note key are simultaneously produced. If, in this case, only one key is depressed, then the output of the AND circuit 286 is at "0", and therefore the repeat key-on signal RKO2 cannot pass through the AND circuit 294 (FIG. 14); that is, no tone is produced. The time interval in which the same tone is repeatedly produced (the time interval being twice as long as the generation interval of the signal RKO2) in the case where plural keys are depressed is equal to that in the case where a single key is depressed.

Banjo repeat

In the case where the banjo tone color (BJ) is selected, simultaneous tone production of depressed keys is repeatedly carried out at desired time intervals. In this case, the twin mallet selection signal TM is at "0", and the AND circuit 316 in the repeat control circuit 277 (FIG. 14) is disabled, and instead the AND circuit 323 is enabled. That is, the outputs Q1, Q2, $\overline{Q3}$, Q4, $\overline{Q5}$ and Q6 of the counter 313 are applied to the AND circuit 323. Thus, when the count value reaches "1 0 1 0 1 1" (42 in decimal notation), the AND circuit 323 outputs a signal "1", which is applied to the OR circuit 317. When the twin mallet trill is selected, the maximum count value of the counter is "32" as described before, and therefore no signal "1" is delivered out from the AND circuit 323.

When the signal "1" is provided by the OR circuit 317, the counter 313 is set to "1 1 1 1 1 1" as described before. Furthermore, similarly as in the above-described case, when the counter value is "0 0 0 0 0 0" and "0 0 0 0 0 1", the repeat key-on signal RKO2 is outputted by the NOR circuit 322. In the case of twin mallet, the counter 313 operates with a modulo of 33. However, in the other case (or in the banjo repeat) the counter 313 operates with a modulo of 43. Therefore, the repeat key-on signal RKO2 is produced every forty-three (43) counts, and the repeat time is longer than in the case of twin mallet trill.

In the case where the banjo tone color is selected, the AND circuit 297 in the signal generation logic 278 is enabled, and the first key-on signal KO1 is applied through the AND circuit 297 and the OR circuit 295 to the AND circuit 294. During the period in which the repeat key-on signal RKO2 is produced, the first key-on signals KO1 of the channels are selected, and are supplied, as the key-on signals KO2S, to the musical tone waveform generating sections 161 (FIG. 9) of the channels ch1 through ch7. With the aid of the control pulses SP1 through SP7, the key-on signals KO1 (KO2S) are latched in the channels ch1 through ch7. Thus, whenever the repeat key-on signal RKO2 is produced, musical tones having percussive envelopes (damping tones) are simultaneously provided by the musical tone waveform generating sections 161 of the channels ch1 through ch7 (however, it should be noted that these channels are ones to which the depressed keys are assigned), so that simultaneous production of plural tones is repeatedly carried out.

In the above-described example, the highest note is detected as the particular note by the particular note detecting circuit 28; however, the invention is not limited thereto or thereby; that is, the circuitry may be so designed that the particular note detecting circuit 28 operates to detect the lowest note. In the case where the lowest note is detected, the comparison circuit 143 in FIG. 6 should be replaced by one which can detect "A<B", and furthermore the key-on signal KO1 for the most significant bit of the input should be inverted to increase the value of that (KO1="0", $\overline{KO1}$="1") for a released key.

In the case where the particular note is an intermediate note, a masking circuit as disclosed in the specification of U.S. Pat. No. 4,192,212, is used to detect a desired intermediate note.

Furthermore, the particular note may be changed according to the number of depressed keys. In this case, a read-only memory (ROM) for reading data which specifies the particular note (or notes) according to the number of depressed keys, and a depressed-key-number detecting circuit should be added.

In general, the twin mallet trill performance effect is provided for keys depressed in one keyboard; however, if necessary, it may be provided for keys depressed in plural keyboards.

As is apparent from the above description, the novel repeated tone performance (twin mallet trill performance) that the tones of keys simultaneously depressed are alternately produced is provided according to this invention, which remarkably improves the performance capability of the electronic musical instrument.

What is claimed is:

1. In an electronic musical instrument having keys for designating notes to be played and key identifying signal generating means for generating key identifying signals representing depressed ones among said keys, a trill performance circuit comprising:

particular note detecting means for detecting as a particular note at least one note among notes corresponding to depressed ones among said keys according to a predetermined detecting logic;

tone producing means for producing tones as determined by said key identifying signals;

tempo pulse generating means for generating a tempo pulse having a predetermined period; and performance control means for controlling said tone producing means so that a tone corresponding to said particular note and tones corresponding to the remaining notes are alternately produced at timings determined by said tempo pulse.

2. A trill performance circuit as claimed in claim 1, in which said particular note detecting means is means for detecting said particular note according to tone pitches.

3. A trill performance circuit as claimed in claim 1, in which said particular note detecting means is means for detecting as a particular note the highest of notes corresponding to said depressed keys.

4. A trill performance circuit as claimed in claim 1, 2 or 3, in which said effect performance control circuit comprises:

repeat signal generating means for generating a repeat signal which is repeadedly generated at predetermined time intervals, according to the tempo pulse provided by said tempo pulse generating means;

a bi-stable circuit whose state is changed in response to said repeat signal; and tone production control means which, when said bi-stable circuit is in one state, allows the tone of said particular note to be produced and which, when said bi-stable circuit is in the other state, allows the tones of said remaining notes to be produced.

5. A trill performance circuit as claimed in claim 4, in which said repeat signal generating means includes a counter which is driven by the tempo pulse which is generated by said tempo pulse generating means, said repeat signal generating means repeatedly carrying out the operation that when the count value of said counter reaches a predetermined value, said repeat signal generating means resets said counter and provides a signal simultaneously.

6. A trill performance circuit as claimed in claim 1, which further comprises:

a plural-key-depression detecting circuit for detecting depression of plural keys; and a repetitive period varying means for varying the repetitive period of a note whose tone production is controlled by said performance control circuit according to an output of said plural-key-depression detecting circuit.

7. A trill performance circuit as claimed in claim 6, in which said plural-key-depression detecting circuit comprises a logic circuit which, when in addition to said particular note a note corresponding to a depressed key is provided, detects said state as a plural-key-depression state.

8. A trill performance circuit as claimed in claim 6, in which said repetitive period varying means is a frequency division circuit which subjects a clock pulse generated by said tempo pulse generating means to frequency division according to an output of said plural-key-depression detecting circuit.

9. A trill performance circuit as claimed in claim 6, in which said repetitive period varying means operates to increase said repetitive period twice when said plural-key-depression detecting circuit detects plural-key-depression.

10. A trill performance circuit as claimed in claim 1, which further comprises: tone color selecting means for selecting one out of plural tone colors; and musical tone control means for controlling musical tone production according to the tone color section of said tone color selecting means.

11. A trill performance circuit as claimed in claim 10, in which said tone color selecting means includes a priority circuit, so that a tone color concerning said performance control means is selected in precedence over the others.

12. A trill performance circuit as claimed in claim 10, in which said musical tone control means includes means for controlling an operation of said performance control means, to enable said performance control means when said tone color selecting means selects a tone color concerning said performance control means.

13. A trill performance circuit as claimed in claim 10, in which said musical tone control means includes octave changing means for changing the octave of a tone to be produced, to enable said octave changing means when said tone color selecting means selects a tone color concerning said performance control means.

14. A trill performance circuit as claimed in claim 9, said octave changing means is means for increasing the octave of a tone to be produced by one octave.

15. A trill performance circuit as claimed in claim 13, in which said musical tone control means includes tone source waveform switching means for switching the waveform of a tone source signal to form a musical tone signal, to control said tone source signal waveform switching means according to the selection operation of said tone color selecting means.

16. A trill performance circuit as claimed in claim 15, in which said tone source signal waveform switching means is means for switching a triangular waveform to a saw tooth waveform and vice versa.

17. A trill performance circuit as claimed in claim 16, in which said source signal waveform switching means comprises: a Gray code converting circuit for converting a plural-bit binary code signal varying repeatedly according to the tone pitch of a musical tone to be produced into a Gray code signal; a selection circuit for selecting one of a Gray code signal outputted by said Gray code converting circuit and a signal consisting of the bits except the least significant bit of said Gray code signal and the most significant bit of said binary code signal; a waveform memory for storing predetermined waveform signals; and means for reading a waveform signal stored in said waveform memory with a signal selected by said selection circuit as an address specifying signal.

18. A trill performance circuit as claimed in claim 15, in which said tone source signal waveform switching means comprises: a Gray code converting circuit for converting a plural-bit binary code signal varying repeatedly according to the tone pitch of a musical tone to be produced into a Gray code signal; a selection circuit for selecting one of a Gray code signal outputted by said Gray code converting circuit and a signal consisting of the bits except the least significant bit of said Gray code signal and the most significant bit of said binary code signal; a waveform memory for storing predetermined waveform signals; means for reading a waveform signal stored in said waveform memory with a signal selected by said selection circuit as an address specifying signal; and means for selectively setting the most significant bit of said binary code signal to a logic level "0", thereby to selectively provide musical tone waveform signals different in footage.

19. An electronic musical instrument comprising:

keys for designating notes to be played;

key code generating means coupled with said keys for generating key codes representing in a digital fashion depressed ones among said keys;

channel assigning means connected to said key code generating means for providing a plurality of channels of time division multiplexed time slots and respectively assigning said key codes to available ones of said channels;

tone producing means connected to said channel assigning means for producing tones as determined by the assigned key codes;

selection means for selecting at least one out of said assigned key codes as particular note;

tempo pulse generating means for generating a tempo pulse having a predetermined period; and performance control means for controlling said tone producing means so that a tone corresponding to the selected key code and tones corresponding to the remaining key codes are produced alternatively at timings determined by said tempo pulse.

20. An electronic musical instrument as claimed in claim 19, in which said selection means comprises: a first comparison circuit for successively subjecting to comparison said key codes which are supplied in time division manner and are assigned to said channels; a memory circuit for storing a key code having the maximum (or minimum) value according to the result of comparison by said first comparison circuit; and a second comparison circuit for comparing said maximum (or minimum) value key code stored in said memory circuit with said key codes assigned to said channels, to detect a channel to which said maximum (or minimum) value key code is assigned.

21. An electronic musical instrument as claimed in claim 19, in which said selection means comprises: a first comparison circuit for successively subjecting to comparison key depression data with the key codes supplied in time division manner and assigned to said channels as the lower significant bits and with key-on signals representative of whether or not keys corresponding to said key codes thus assigned are depressed as the most significant bits; a memory circuit for storing the maximum (or minimum) key depression data according to the result of comparison made by said first comparison circuit; and a second comparison circuit for comparing the maximum (or minimum) key depression data thus stored with said key depression data assigned to said channels, to detect a channel to which said maximum (or minimum) key depression data is assigned, thereby to give preference to key depression data corresponding to keys which are being depressed.

22. An electronic musical instrument as claimed in claim 20 or 21, in which said performance control means comprises:

tone production timing signal generating means for generating tone production timing signal having a predetermined pulse width which is provided at predetermined time intervals in response to the tempo pulse produced by said tempo pulse generating means;

repeat signal generating means for generating a repeat signal having the same period as that of said tone production timing signal in correspondence to said tone production timing signal;

a bi-stable circuit whose state is changed according to said repeat signal;

distributing means which, when said bi-stable circuit is in one state, distributes said tone production timing signal to a channel selected by said second comparison circuit and which, when said bi-stable circuit is in the other state, distributes said tone producing timing signal to channels, except said channel selected by said second comparison circuit, to which said key codes representative of depressed keys are assigned; and musical tone switching means for producing, in said channels to which said tone production timing signal is distributed, tones corresponding to said key codes assigned to said channels.

23. An electronic musical instrument as claimed in claim 22, in which said tone production timing signal generating means and said repeat signal generating means are so arranged that said repeat signal is provided immediately before said tone production timing signal.

24. An electronic musical instrument as claimed in claim 22, in which said distributing means comprises: an EXCLUSIVE OR circuit to which an output of said bi-stable circuit and a signal representative of a channel selected by said second comparison circuit are applied; a first gate circuit for selectively passing signals representative of said channels to which said key codes corresponding to depressed keys are assigned, according to an output of said EXCLUSIVE OR circuit; and a second gate circuit for passing said tone production timing signal according to an output of said first gate circuit.

25. An electronic musical instrument as claimed in claim 22, in which said musical tone switching means comprises: a time constant circuit for forming an envelope signal according to said tone production timing signal; and means for subjecting to amplitude envelope control a tone source signal corresponding to a tone to be produced, according to an output of said time constant circuit.

26. A trill performance circuit in an electronic musical instrument, which comprises:

tempo pulse generating means;

means for generating a repeat signal which is repeatedly provided with a predetermined period, according to a tempo pulse generated by said tempo pulse generating means;

means for generating a tone production timing signal in correspondence to said repeat signal;

a bi-stable circuit whose state is changed according to said repeat signal;

particular note detecting means for detecting a particular note among notes corresponding to depressed keys;

a plural-key-depression detecting circuit for detecting depression of a plurality of keys; and tone production timing control means which, when depression of a plurality of keys is detected by said plural-key-depression detecting circuit, allows said particular note and the remaining notes to be alternatively produced according to the states of said bi-stable circuit, and, when depression of a plurality of keys is not detected, allows said particular note to be repeatedly produced according to said tone production timing signal.

* * * * *